US007611445B2

(12) United States Patent
Brown et al.

(10) Patent No.: US 7,611,445 B2
(45) **Date of Patent: *Nov. 3, 2009**

(54) ABDOMINAL EXERCISE MACHINE

(75) Inventors: Wallace Brown, Mendham, NJ (US); Robert W. Nelson, Rowlett, TX (US)

(73) Assignee: AB Coaster Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/211,800

(22) Filed: Sep. 16, 2008

(65) Prior Publication Data

US 2009/0018000 A1 Jan. 15, 2009

Related U.S. Application Data

(63) Continuation-in-part of application No. 11/982,856, filed on Nov. 5, 2007, which is a continuation-in-part of application No. 11/607,745, filed on Nov. 30, 2006, now Pat. No. 7,455,633, and a continuation-in-part of application No. 11/030,420, filed on Jan. 5, 2005, now Pat. No. 7,232,404.

(60) Provisional application No. 60/741,104, filed on Nov. 30, 2005, provisional application No. 60/541,744, filed on Jan. 5, 2004.

(51) Int. Cl.
*A63B 71/00* (2006.01)

(52) U.S. Cl. ..... 482/51; 482/140

(58) Field of Classification Search ..... 482/72, 482/142, 140, 91–96, 62, 69, 143, 907, 51, 482/135, 139, 148; D21/662, 676, 686, 674, D21/690

See application file for complete search history.

(56) References Cited

U.S. PATENT DOCUMENTS

| | | | |
|---|---|---|---|
| 326,447 | A | 9/1885 | Root |
| 567,915 | A | 9/1896 | McLarty |
| 2,183,345 | A | 12/1939 | Brandon |
| 3,759,511 | A | 9/1973 | Zinkin et al. |

(Continued)

FOREIGN PATENT DOCUMENTS

| | | |
|---|---|---|
| GB | 1318240 | 5/1973 |

OTHER PUBLICATIONS

AB Lounge, website description from www.fitnessquest.com, submitted with parent nonprovisional patent application, U.S. Appl. No. 11/030,420.

(Continued)

*Primary Examiner*—Lori Amerson
(74) *Attorney, Agent, or Firm*—Cislo & Thomas, LLP

(57) ABSTRACT

A machine, apparatus, and method for targeting the abdominal and oblique muscle groups. The abdominal exercise system includes a frame, carriage, and an upper body support. In one embodiment, the user places at least a portion of their lower body on the carriage. The user leans their forearms and elbows against an angled upper body support while grasping a set of handles to secure the user's upper body. In turn, the user swings the carriage back and forth along an arcuate path beginning at a position behind the upper body support and ending at a position in front of the upper support, thereby contracting and relaxing the abdominal muscle group.

14 Claims, 16 Drawing Sheets

U.S. PATENT DOCUMENTS

| | | | | |
|---|---|---|---|---|
| 4,176,836 | A | 12/1979 | Coyle | |
| 4,746,116 | A * | 5/1988 | Inada | 482/146 |
| 4,930,769 | A | 6/1990 | Nenoff | |
| 5,376,053 | A | 12/1994 | Ponder et al. | |
| 5,429,567 | A | 7/1995 | Gerschefske et al. | |
| 5,518,483 | A | 5/1996 | Oswald | |
| 5,527,249 | A | 6/1996 | Harris | |
| 5,620,403 | A | 4/1997 | Lundin | |
| 5,746,688 | A | 5/1998 | Prager | |
| D397,745 | S | 9/1998 | Wu | |
| D425,585 | S | 5/2000 | Wu | |
| 6,183,397 | B1 | 2/2001 | Steams et al. | |
| 6,196,954 | B1 | 3/2001 | Chen | |
| 6,244,955 | B1 | 6/2001 | Bischoff et al. | |
| 6,440,045 | B1 | 8/2002 | Gaston | |
| 6,634,996 | B2 | 10/2003 | Jacobsen | |
| 6,645,129 | B2 | 11/2003 | Eschenbach | |
| 7,066,868 | B2 * | 6/2006 | Van Den Heever | 482/142 |
| 7,083,556 | B1 | 8/2006 | Miskech | |
| 7,125,371 | B2 | 10/2006 | Henderson | |
| 7,179,212 | B2 | 2/2007 | Hsuing at al. | |
| 7,232,404 | B2 | 6/2007 | Nelson | |
| 7,244,217 | B2 | 7/2007 | Rodgers, Jr. | |
| 7,270,628 | B2 | 9/2007 | Campanaro et al. | |
| D565,134 | S | 3/2008 | Brown et al. | |
| 2005/0085348 | A1 | 4/2005 | Kiefer et al. | |
| 2006/0100070 | A1 | 5/2006 | Abdo | |
| 2007/0149370 | A1 | 6/2007 | Brown et al. | |
| 2007/0184949 | A1 | 8/2007 | Weir et al. | |
| 2008/0070766 | A1 | 3/2008 | Brown et al. | |

OTHER PUBLICATIONS

AB Scissor, website description from www.bodybyjake.com, submitted with parent nonprovisional patent application, U.S. Appl. No. 11/030,420.

AB Dolly2, website description from www.fitnessquest.com, submitted with parent nonprovisional patent application, U.S. Appl. No. 11/030,420.

AB Slide[r], website review of the AB Slide[r] from www.fitnessquest.com, submitted with parent nonprovisional patent application, U.S. Appl. No. 11/030,420.

AB Slider, website description from www.wonderfulbuys.com, submitted with parent nonprovisional patent application, U.S. Appl. No. 11/030,420.

http://lagym.com/frame2/itemenlarge.asp?ProductID=730921 &FileExt=jpg%20 &Description=LIFE%20FITNESS%20PR02%20SE%20DIP/ %20CHIN%20ASSIST; showing Life Fitness Pro2 SE Dip/Chin Assist device.

Amerson, Lod Baker; Office Action entered Oct. 17, 2008 in Applicants' co-pending U.S. Appl. No. 11/982,856.

Amerson, Lori Baker, Notice of Allowability mailed on Sep. 22, 2008 in Applicants' co-pending U.S. Appl. No. 11/607,745.

Amerson, Lori Baker; Office Action mailed on Apr. 21, 2008 in Applicants' co-pending U.S. Appl. No. 11/983,040.

Amerson, Lori Baker; Office Action entered Apr. 7, 2008 in Applicants' co-pending U.S. Appl. No. 11/982,856.

Amerson, Lod Baker; Office Action mailed on Mar. 24, 2008 in Applicants' co-pending U.S. Appl. No. 11/607,745.

Richman, Glenn; Transmittal of International Search Report and Written Opinion mailed on Feb. 14, 2008 in Applicants' co-pending PCT International Application No. PCT/US07/04173.

* cited by examiner

ABDOMINAL EXERCISE MACHINE

CROSS-REFERENCE TO RELATED APPLICATIONS

This patent application is a continuation-in-part of U.S. application Ser. No. 11/982,856, filed Nov. 5, 2007, which is a continuation-in-part of U.S. application Ser. No. 11/607,745 filed Nov. 30, 2006, now U.S. Pat. No. 7,455,633 which claims the benefit of U.S. Provisional Patent Application Ser. No. 60/741,104 filed Nov. 30, 2005 and is a continuation-in-part of U.S. application Ser. No. 11/030,420 filed Jan. 5, 2005, now U.S. Pat. No. 7,232,404 which claims the benefit of U.S. Provisional Patent Application Ser. No. 60/541,744 filed Jan. 5, 2004, which references are incorporated here by this reference.

TECHNICAL FIELD

This application relates to exercise equipment and more, particularly to exercise machines having a swing apparatus and an upper body support to target an abdominal muscle group.

BACKGROUND

Traditional abdominal exercises, such as sit-ups are known to cause overload to the spine and neck and can easily cause injury when sitting up from a prone position to a sitting position. To correct this problem, many devices and exercises have been created in an attempt to develop and maintain the abdominal muscles. Unfortunately these devices and exercises often produce results which do not necessarily strengthen the abdominal muscles but strengthen the hip and thigh muscles attached to the lumbar spine area and to the rear of the pelvis and hip bones. When such muscles contract not only does the rectus muscle of the abdomen work with little effort but the other muscles rotate the pelvis forward thus creating the occurrence of increased lower back pain which contributes to poor mechanical alignment and undesirable upright posture of the exerciser.

For example, abdominal exercises that use arm slings and the person hanging from a bar are only beneficial to advanced athletes that are able to perform the exercise effectively. However, even when performed effectively, the back is extremely overloaded and the hip-flexors handle much of the load creating a risk of injury.

Also, lower abdominal exercises utilizing leg raises or reverse crunches where the knees are raised to the chest while the body is suspended vertically, supported only by arms or elbows, are strenuous on the lower back and offer minimal back support. These types of exercises are especially bad due to excessive strain on the back caused by lifting the knees to the chest. Furthermore, a significant number of people who do this type of abdominal exercise become injured with continued use.

Also, some exercise machines concentrate on cardio training with too little resistance thereby producing semi-effective strength training with very limited results. For example, exercise machines similar to the AB LOUNGE or AB SCISSOR provide more isolation than the above abdominal exercise but do not provide enough resistance because the exercise motions performed with these devices do not provide a resistance that is consistent with strength training.

In addition, exercise machines similar to the AB DOLLEY or AB SLIDE are effective for upper abdominal muscles and upper torso but not for lower abdominals. Also, exercises using these types of devices are difficult and dangerous for two reasons: first resistance is concentrated downward by gravity making isolation on the abdominal muscles impossible, as the entire upper torso, front and back muscles, and arms are needed to handle the load; and second, the user's back is forced into an ergonomically unfriendly angle with the upper body which is operating too low in conjunction with the lower body. Such a position is uncomfortable, awkward and can cause injury.

What is needed is an abdominal exerciser that will isolate the upper and lower abdominal muscles with true strength conditioning to change the shape of the overall abdomen muscle structure without compromising safety or support for the back. It would be beneficial if the apparatus could enable a user to execute the abdominal exercise in a biometrically neutral position, minimizing or eliminating back and neck strain. It would also be beneficial if the user could perform an upper abdominal crunch simultaneously with a controlled and supported reverse crunch. It would further be beneficial if the apparatus could allow the user to hold either the upper or lower crunch in a fully contracted "isometric" position while continuing with the opposite crunch rendering a dynamically concentrated isolation of the abdominal muscles.

SUMMARY OF APPLICATION

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one aspect of the present application, an exercise machine to work a user's abdominal muscle group is presented. The exercise machine includes a frame, an upper body support attached to the frame, and a swing assembly attached to the frame. The swing assembly includes a swing arm connected to the carriage. The carriage traverses back and forth along an arcuate path defined by the swing arm and capable of pivoting in front of the upper body support.

In accordance with another aspect of the present application, an abdominal exercise apparatus to work a user's abdominal and oblique muscle groups and to isolate an upper and lower abdominal muscle group in a biometrically neutral position is presented. The abdominal exercise apparatus includes a frame, an upper body support coupled to the frame and angled for back support, and a swing assembly pivotally connected to the frame. The swing assembly includes a swing arm connected to a carriage. The carriage is positioned directly below the upper body support when the user is in a contracted abdominal position and below and in back of the upper support when the user is in a relaxed abdominal position.

In accordance with still yet another aspect of the present application, an exercise method for targeting a user's abdominal muscle group and to isolate an upper and lower abdominal muscle group in a biometrically neutral position is presented. The exercise method includes placing at least a portion of a user's lower body on a carriage and positioning a user's upper body to an upper support. In addition, the method includes using an abdominal muscle group to swing the carriage back and forth along an arcuate path. The path begins at a position behind the upper support and ends at a position in front of the upper support.

BRIEF DESCRIPTION OF THE DRAWINGS

The novel features believed characteristic of the application are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The application itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
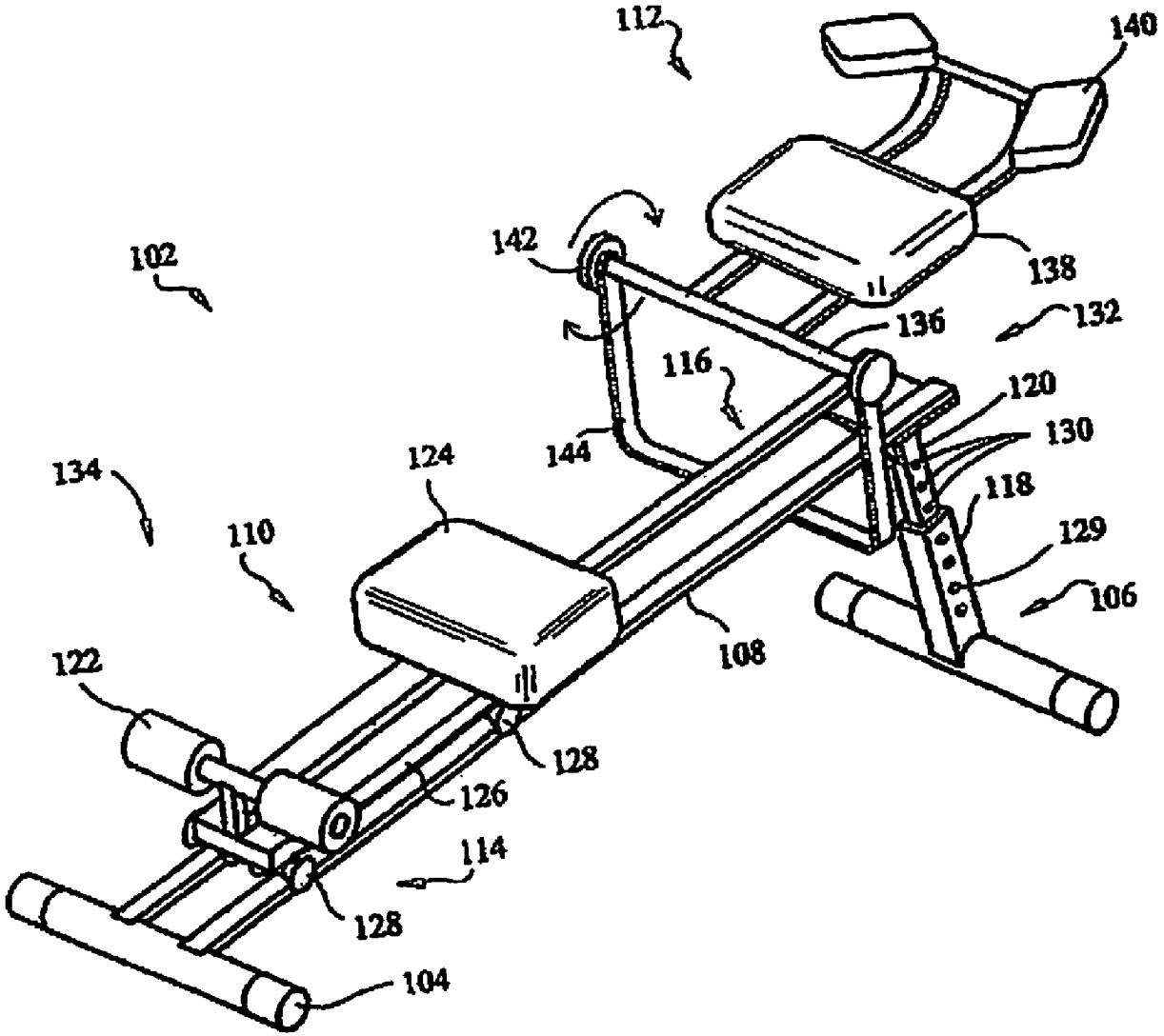
FIG. 1 is a perspective view of one embodiment of an exemplary abdominal exercise apparatus in accordance with one aspect of the present application.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

The abdominal exerciser of the present application isolates the upper and lower abdominal muscles with true strength conditioning to change the shape of the overall abdomen muscle structure without compromising safety or support for the back. It also enables a user to execute the abdominal exercise in a biometrically neutral position, minimizing or eliminating back and neck strain. In one embodiment, the abdominal exerciser of the present application allows a user to perform an upper abdominal crunch simultaneously with a controlled and supported reverse crunch. Also, it allows a user to hold either the upper or lower crunch in a fully contracted isometric position while continuing with the opposite crunch rendering a dynamically concentrated isolation of the abdominal muscles.

FIG. 1 shows one embodiment of the abdominal exerciser 102. Abdominal exerciser 102 has a front portion 132, rear portion 134 and contains rear support 104, forward support 106, track 108, sled 110, and upper body support 112.

Rear support 104 rests on the ground and provides foundational support for abdominal exerciser 102. Rear support 104 may have a long tubular profile, a solid square or rectangular profile, or any other profile known in the art for use as support of a bench like structure similar to abdominal exerciser 102. Rear support 104 is attached to track 108.

Figure 5A:
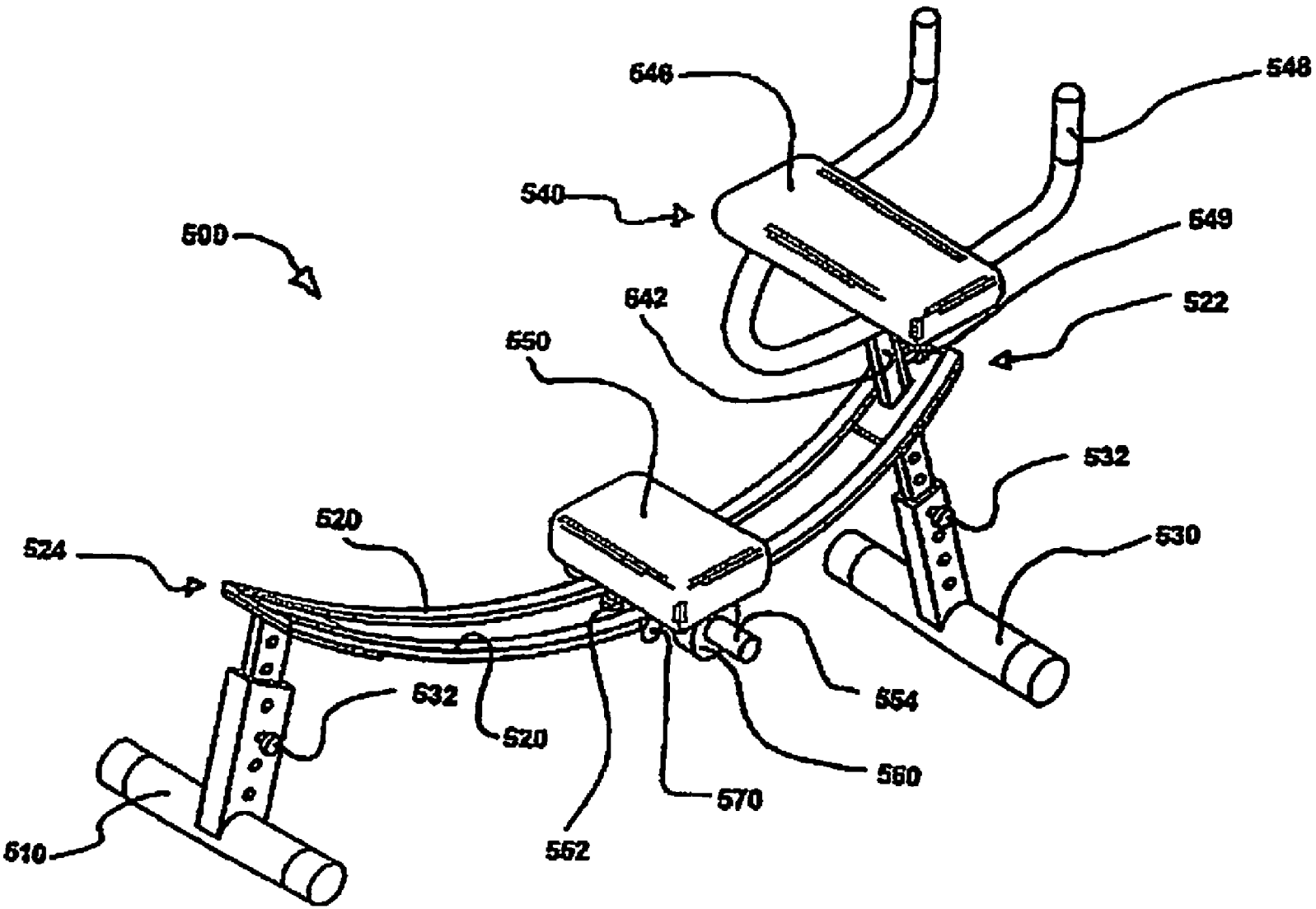
FIG. 5A is a perspective view of another exemplary embodiment in accordance with one aspect of the present application.
Figure 5B:
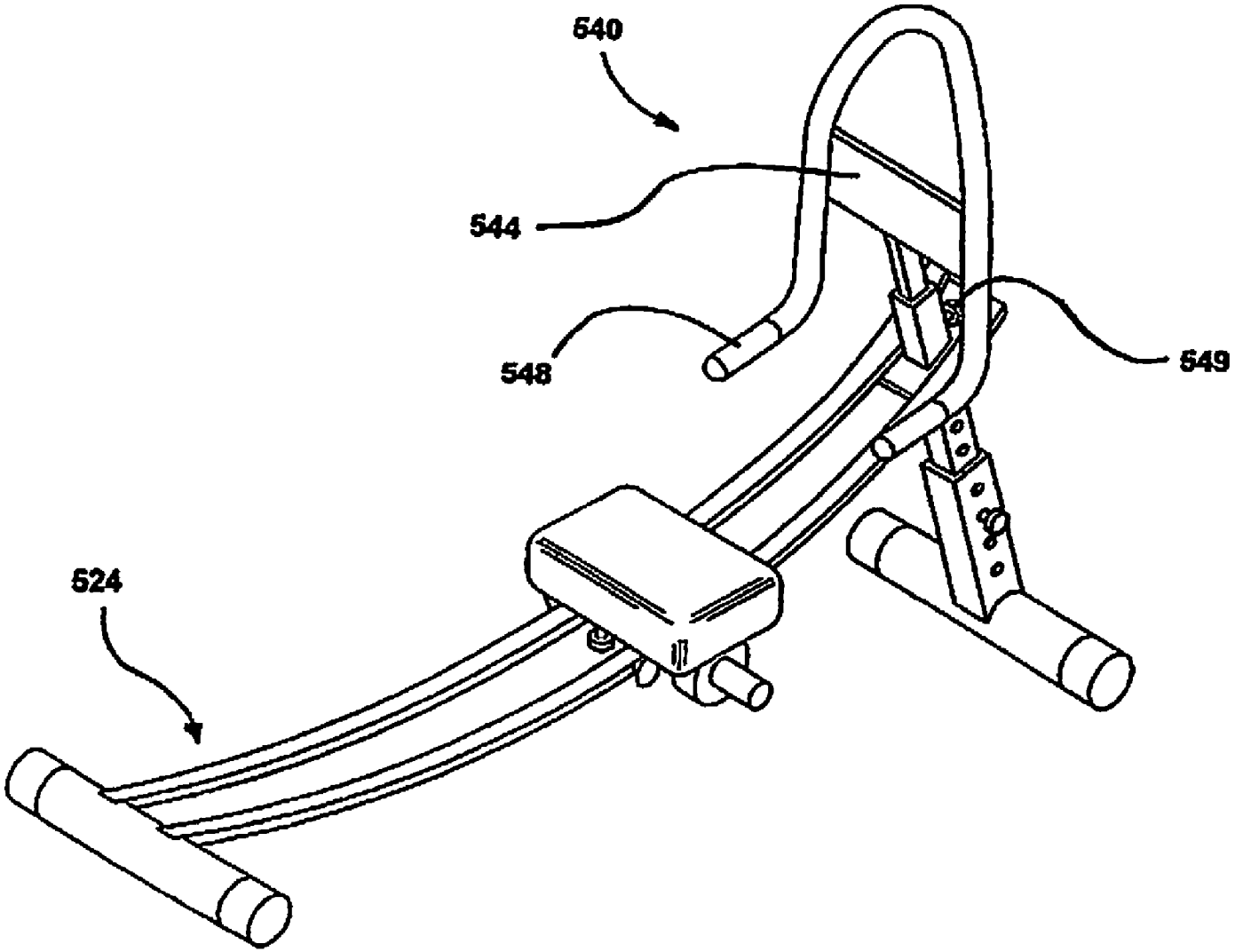
FIG. 5B is a perspective view of another exemplary embodiment in which the illustrative upper body support is rotated into a second position in accordance with one aspect of the present application.

Track 108 can be made of metal, plastic with a metal or TEFLON® coating or some other material that has a relatively low coefficient of friction with the material used to make roller 128. In the preferred embodiment there are two tracks 108, however in other embodiments there may be only one track or, alternatively, more than two tracks. Track 108 extends from rear support 104 to forward support 106 and has a rear portion 114 proximate to rear support 104 and a forward portion 116 proximate to forward support 106. In another preferred embodiment, track 108 can be curved as shown in FIGS. 5A-5B. The curvature can be circular, ellipsoid, parabolic, or any other curved shape that advantageously affects the abdominal and oblique muscles.

In one embodiment the front foundation includes a telescopic extension to raise the height of one end of the track to a desired level of inclination. Forward support 106 elevates forward portion 132 of track 108 at least approximately 6 inches off the ground and contains hollow outer base 118 and adjustable top portion 120 and provides foundational support for abdominal exerciser 102. Base 118 may have a long tubular profile, a solid square or rectangular profile, or any other profile known in the art for use as support for a bench like structure similar to abdominal exerciser 102.

Adjustable top portion 120 is slidably mounted within outer base 118 in telescoping relation. By sliding the adjustable top portion 120 inwardly or outwardly relative to outer base 118, the overall length of forward support 106 can be selectively changed to vary the height of forward support 106. A locking means is provided for locking outer base 118 and adjustable top portion 120 in desired relative positions to create a desired length for forward support 106.

Preferably, the locking means includes at least one hole 129 in outer base 118 and a plurality of holes 130 in adjustable top portion 120 which can be selectively aligned with at least one hole 129 in outer base 118. A pin member is constructed to be inserted in the aligned holes, thereby securely locking forward support 106 in the desired length. At least one hole 129 and holes 130 may be threaded holes, and the pin member may have cooperating threads to enable the pin to be threaded or screwed into the holes to secure forward support 106 at a desired length. Track 108 is secured to forward support 106 and forward support 106 elevates tracks 108 to a desired level, preferably at least approximately 6 inches above to provide an incline.

Sled 110 glides along track 108. Sled 110 contains sled base 126. Attached to sled base 126 are instep pad 122, knee pad or leg support 124, and roller 128. Roller 128 may be made of metal, plastic with a metal or TEFLON® coating or some other material that has a relatively low coefficient of friction on the material used to make track 108. In an alternate embodiment, roller 128 may be ball bearings, roller bearings or some other means which would allow sled 110 to travel along track 108 with a relatively low coefficient of friction.

Instep pad 122 is made of dense foam, rubber, or some other similar material. The purpose of instep pad 122 is to elevate the feet to avoid interfering with the movement of the sled. Other means may be used to elevate the feet such as a wedge or the feet may not be elevated at all.

In one embodiment, knee pad 124 can pivot up to approximately 45 degrees to the right or left of a plane vertical to the center of sled 110. By pivoting knee pad 124 the oblique muscles can be effectively exercised.

Sled 110 can travel the entire length of track 108 but preferably travels to the approximate area of upper body support 112.

Upper body support 112 is attached to front portion 132 of abdominal exerciser 102 and comprises at least one handle 548. In another embodiment, the upper body support 112 comprises an elevation bar 144 attached to the track 108 and at least one handle 548 attached to the elevation bar 144. In another embodiment the upper body support can comprise an elevation bar 144, a cross bar 136, an arm pad or arm support 138, and a chest pad or chest support 140. Elevation bar 144 is attached to track 108 such that sled 110 can travel past elevation bar 144. In an alternate embodiment, elevation bar 144 is attached to track 108 such that sled 110 cannot travel past elevation bar 144. In addition, elevation bar 144 may be attached to forward support 106. Cross bar 136 is pivotally attached to elevation bar 144 and suspend approximately 12 to 48 inches above track 108.

Cross bar 136 is pivotally attached to elevation bars such that the amount of torque required to rotate cross bar 136 can be adjusted, preferably by tension control member 142. Tension control member 142 controls the amount of resistance required to rotate cross bar 136 and can be set such that cross bar 136 may be locked in any rotational position especially one where arm pad 138 has been rotated towards track 108.

In an alternate embodiment the handles 548 can be pivotally attached to the elevation bar 144 and suspended approximately 12 to approximately 48 inches above the track 108.

Arm pad or arm support 138 is attached to cross bar 136, has a general rectangular or square profile, and is made of dense foam or some other similar material. Arm pad 138 provides support for the arms during use. Chest pad 140 is attached to arm pad 138 and elevated approximately 1 to 36 inches above arm pad 138. Chest pad 140 has a general cylindrical, rectangular, or square profile and is made of dense foam or some other similar material. Chest pad 140 provides support for the chest during use. In an alternate embodiment, a head support may be used to support the head. In addition, shoulder pads may be used in conjunction with or to replace chest pad 140. Other means to support the upper body of the user would be apparent to one skilled in the art.

Figure 2:
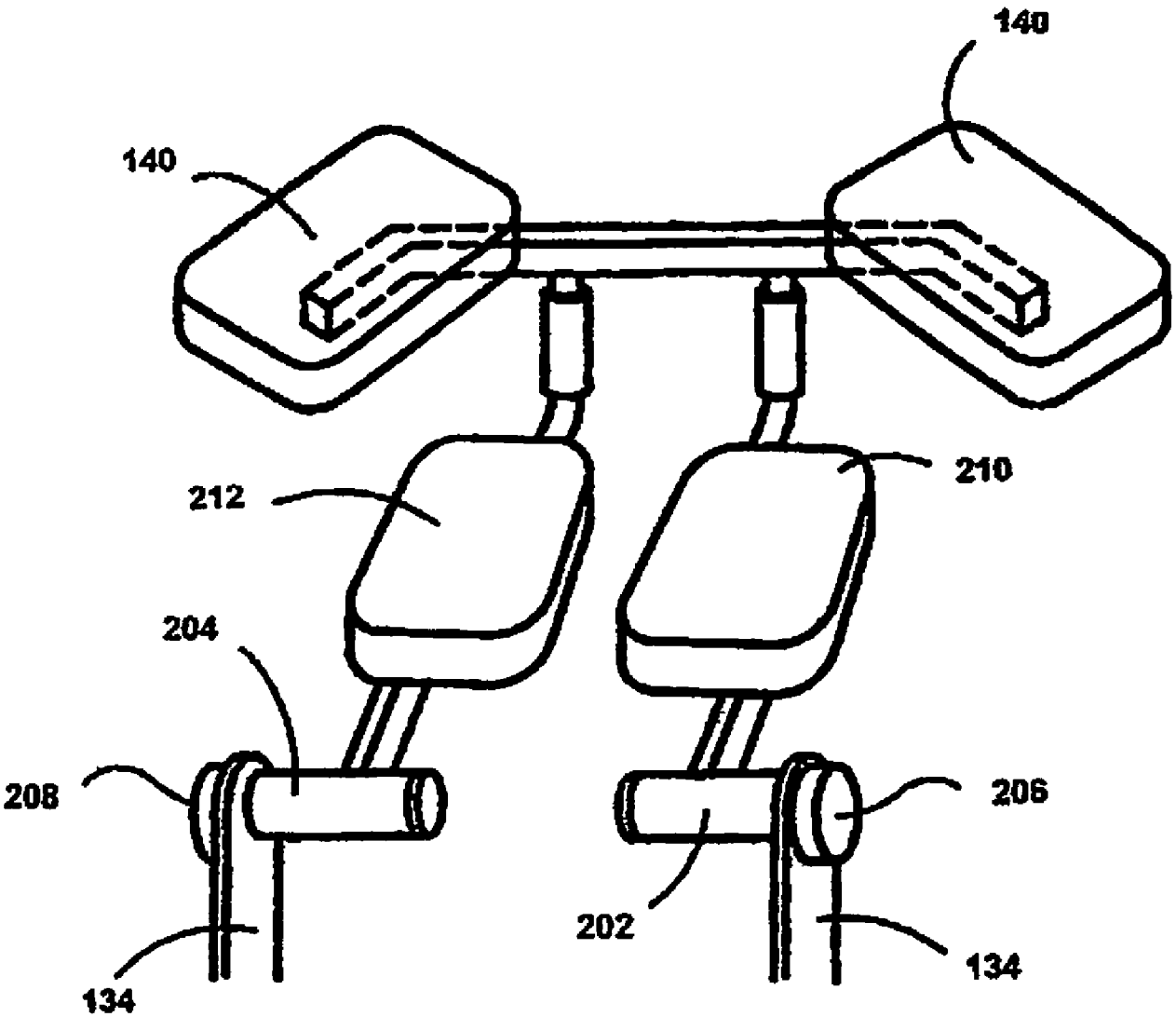
FIG. 2 is a front view of an alternate embodiment of an illustrative upper body support of an exemplary abdominal exercise apparatus in accordance with one aspect of the present application.

In an alternate embodiment, shown in FIG. 2, the cross bar 136 is divided into two sections, right bar section 202 and left bar section 204. Right bar section 202 and left bar section 204 are pivotally attached to elevation bar 144 such that the torque required to rotate right bar section 202 and left bar section 204 can be adjusted, preferably by a tension control members 206 and/or 208 respectively. Tension control members 206 and 208 controls the amount of resistance required to rotate right bar section 202 and left bar section 204 and can be set such that right bar section 202 and left bar section 204 may be locked in any rotational position especially one where arm pad 138 has been rotated towards the track 108. Tension control members 206 and 208 have markings or slots such that each one can be set to the same tension as the other or only one tension control member may be used to control the amount of resistance required to rotate the upper body support 112.

The chest pad 140 is also divided into two sections, right pad 210 and left pad 212. Right pad 210 and left pad 212 are attached to right bar section 202 and left bar section 204 respectively. In an alternate embodiment, chest pad 140 is a single one piece member.

Figure 3:
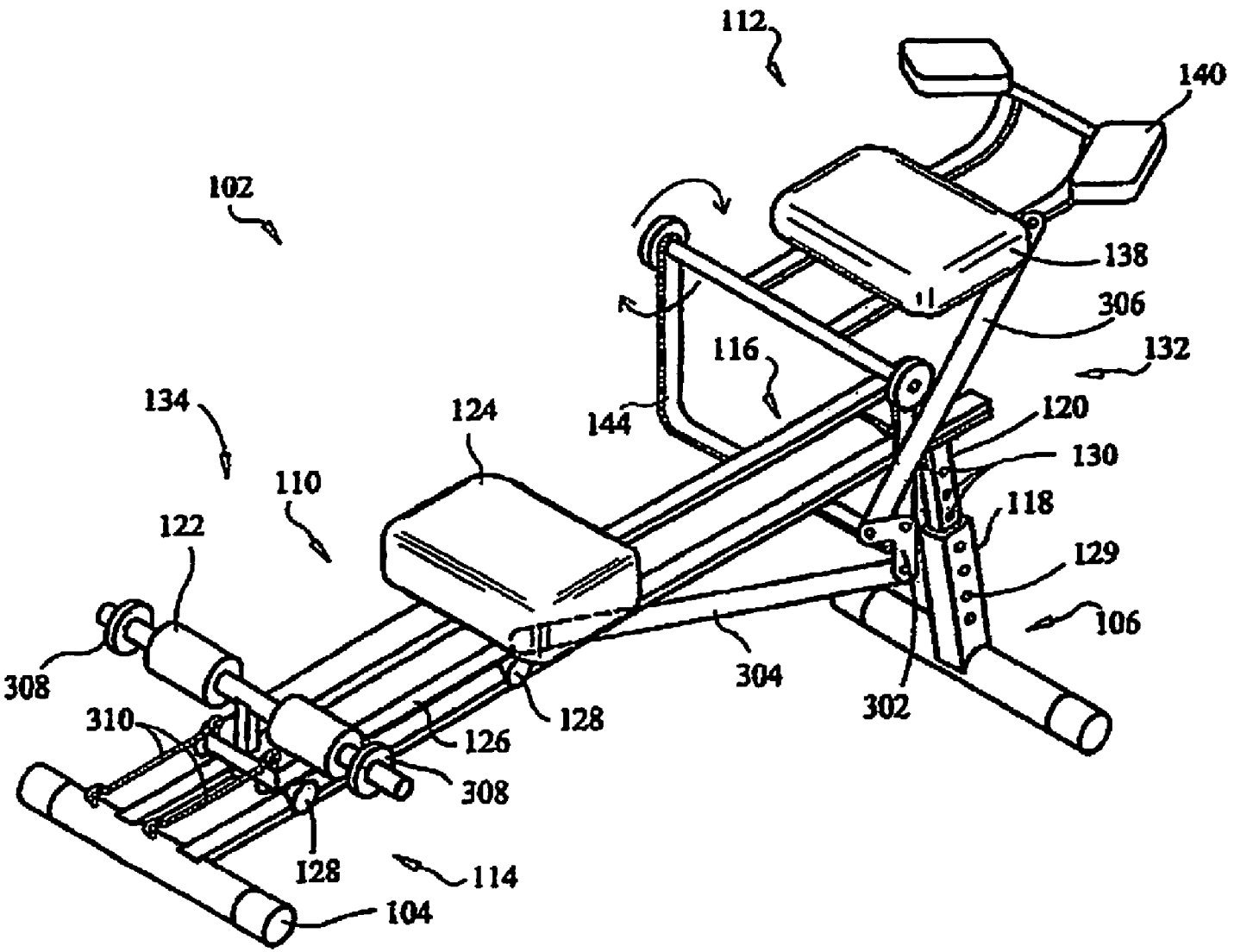
FIG. 3 is a perspective view of an alternate embodiment of an exemplary abdominal exercise apparatus in accordance with one aspect of the present application.

FIG. 3 shows an alternate embodiment wherein upper body support 112 is pivoted when sled 110 is accelerated towards upper body support 112. Near the point of maximum forward motion of the sled, the user has the option to rock the upper body support forward simulating a sit up or what is known as a "crunch" motion. As shown in FIG. 3, the pivot means is a bell crank with pivot member 302 attached to elevation bar 144, lower arm 304 attached to sled 110, and upper arm 306 attached to upper body support 112. In use, when sled 110 is accelerated towards upper body support, lower arm 304 pushes pivot member 302 causing it to rotate and pull down on upper arm 306, which causes upper body support 112 to rotate. A second function of the pivot means is to help accelerate sled 110 towards upper body support 112 by rotating upper body support 112 towards track 108.

Use of a pivot means, such as the bell crank, forces the user to perform an upper abdominal crunch simultaneously with a controlled and supported reverse crunch. As would be known in the art, other means may be used to pivot upper body support 112 when sled 110 is accelerated towards upper body support 112. For example, other mechanical means similar to a bell crank or a cable and pulley system may be used to pivot upper body support 112 when sled 110 is accelerated towards upper body support 112.

Resistance to sliding the sled is provided by a user's body weight working against gravity, as it is forced upward on the inclined tracks. Resistance can be increased or decreased by raising and lowering the level of incline. Optionally, a resistance member 310 such as a spring, resistance band, or free weights attached to the sled, may be used for additional resistance. Resistance bands are elastic and attached to rear support 104 and sled 110.

Figure 4:
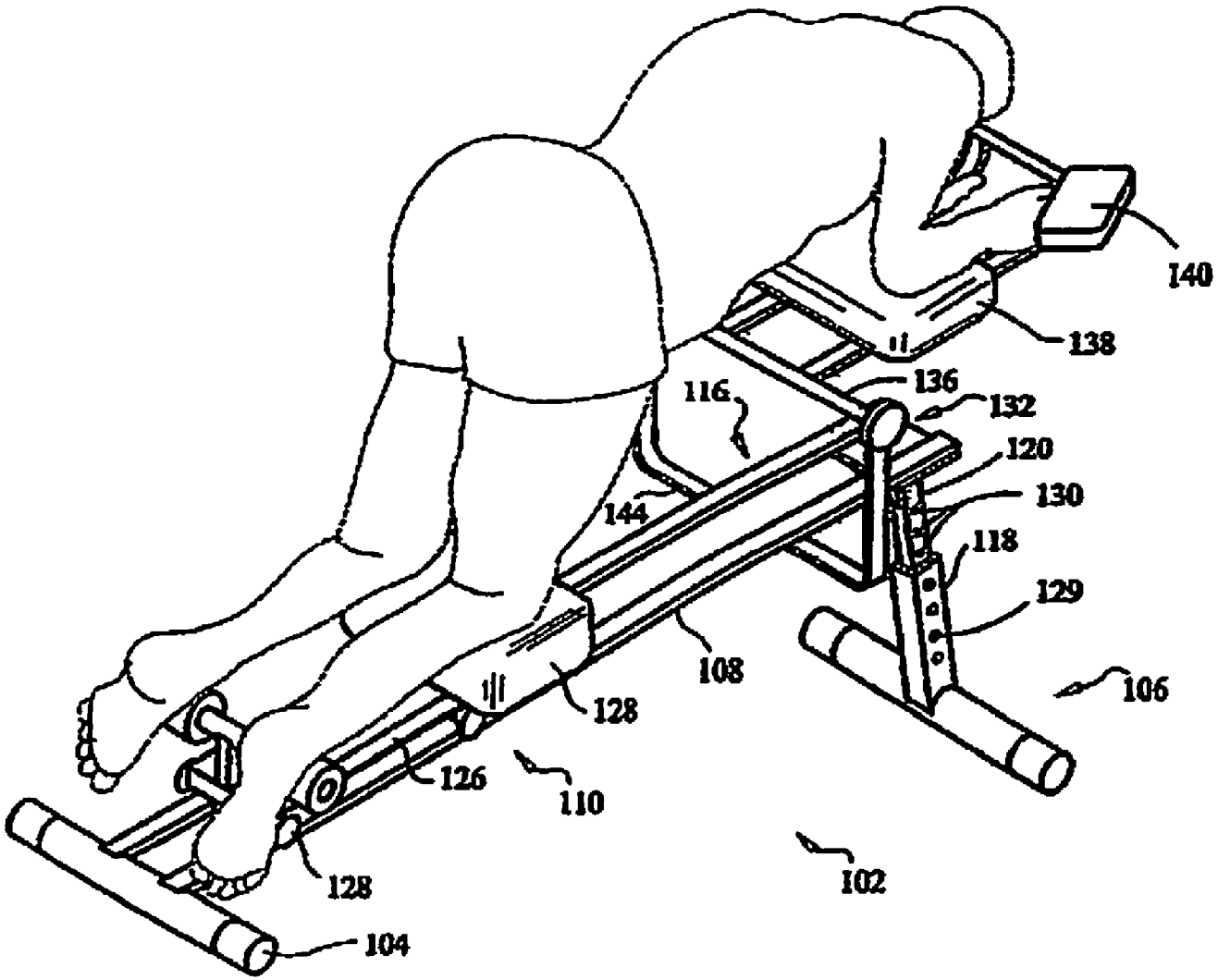
FIG. 4 is a perspective view of the exemplary apparatus shown in FIG. 1 in use by a person in accordance with one aspect of the present application.

In use, as shown in FIG. 4, the forearms are positioned on upper body support 112 and the shins are positioned onto instep pads 122 on sled 110. Sled 110 is then accelerated towards upper body support 112 by bringing the knees as close as possible to upper body support 112 or the user's chin while keeping forearms positioned on upper body support 112.

By pivoting knee pad 124 up to approximately 45 degrees to the right or left of a plane vertical to the center of sled 110 the force needed to accelerate sled 110 can be supplied by the right or left oblique muscles. In addition, the knees may be brought as high as possible at the peak of the contracted point of both crunches, rendering a tight squeeze in a near fetal position.

To perform an upper body crunch the legs are frozen at a 90 degree angle with respect to knee pad 124 while sled 110 is accelerated towards upper body support 112 and cross bar 136 is pivoted towards track 108. Then, using the upper abdominal muscles, sled 110 is made to travel back and forth along track 108 while the legs and hips remaining locked at a 90 degree angle with respect to knee pad 124.

To perform a reverse crunch, the knees are allowed to freely move while sled 110 is accelerated towards upper body support 112 but cross bar 136 is not allowed to pivot in any direction. Then, using the lower abdominal muscles, sled 110 is made to travel back and forth along track 108 while cross bar 136 is locked in a desired position.

To perform a tandem crunch and exercise both the upper and lower abdominal muscles, the knees are allowed to freely move while sled 110 is accelerated towards upper body support 112 and cross bar 136 is pivoted towards track 108. Then, the upper and lower abdominal muscles are used to force sled 110 to travel back and forth along track 108 while cross bar 136 is pivoted towards track 108.

FIG. 5A shows another preferred embodiment of the abdominal exerciser 500 to work the abdominal and oblique muscle groups and isolate the upper and lower abdominal muscles in a biometrically neutral position. The abdominal exerciser 500 can have a rear support 510, at least one track 520, a front support 530, an upper body support 540 and a sled 600 with or without a knee pad or leg support 550. In a preferred embodiment the track 520 can be an arcuate track 520.

FIG. 5A shows the arcuate track 520 with a front portion 522 and a back portion 524 where the front portion 522 of the arcuate track 520 is attached to the front support 530 and the back portion 524 of the arcuate track 520 is attached to the rear support 510 such that the front portion 522 is at least approximately 6 inches off the ground. Having the front portion 522 elevated at least 6 inches above the ground is beneficial in a number of ways. For instance, this elevation causes the user to oppose the force of gravity by contracting the abdominal muscles when in the crunch position (see FIG. 7B). It also allows the user to exercise in an upright, forward leaning position, much like a bicyclist's pose. This is convenient and familiar to most users and maintains the user's upper body in a fixed, still state allowing the user to read or watch a television show during an exercise.

The track 520 can be curved as shown in FIG. 5A. The curvature can be circular, ellipsoid, parabolic, or any other curved shape that advantageously affects the abdominal and oblique muscles.

Figure 7A:
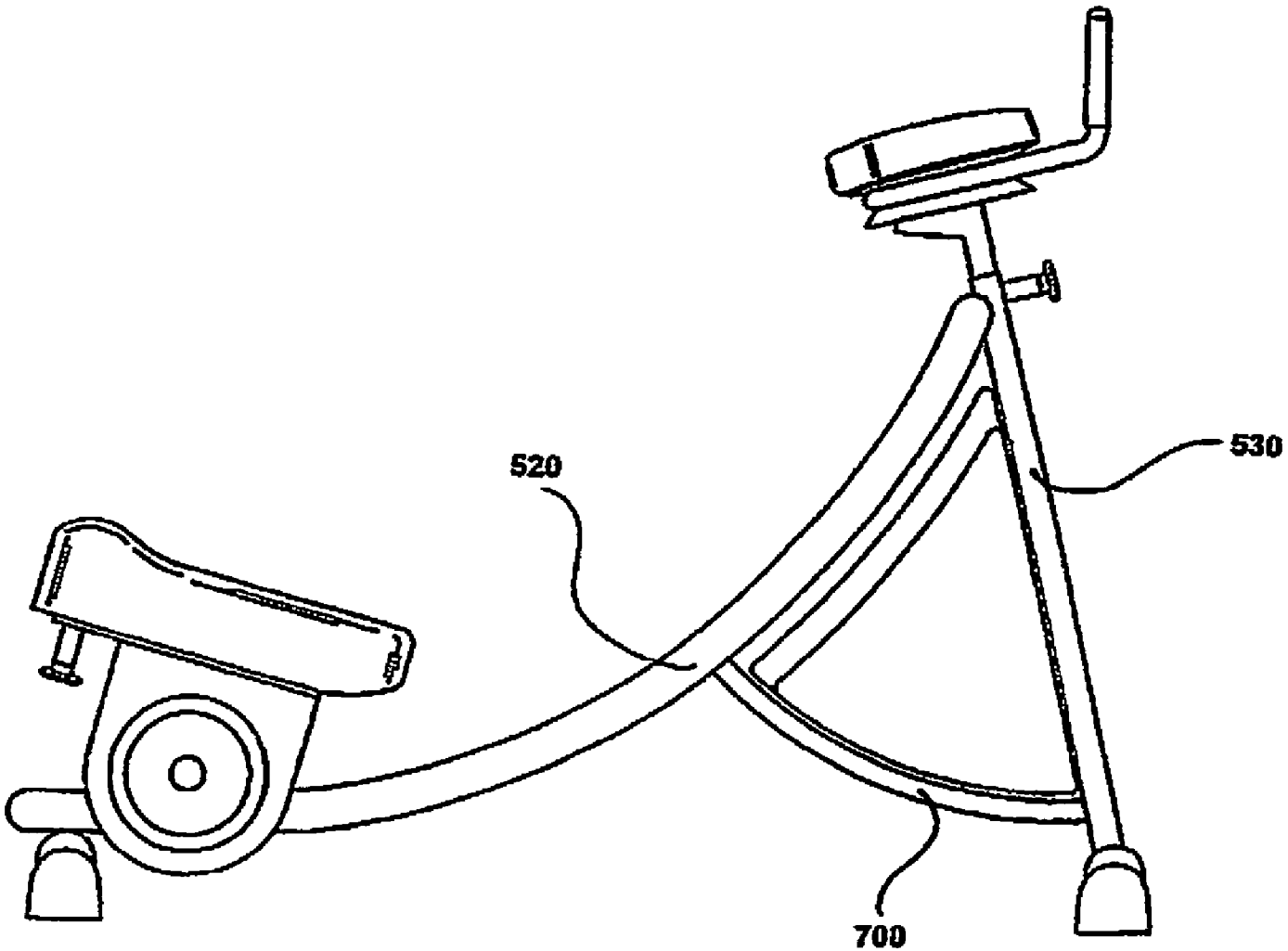
FIG. 7A is a side view of the exemplary embodiment of FIG. 6 in accordance with one aspect of the present application.
Figure 7B:
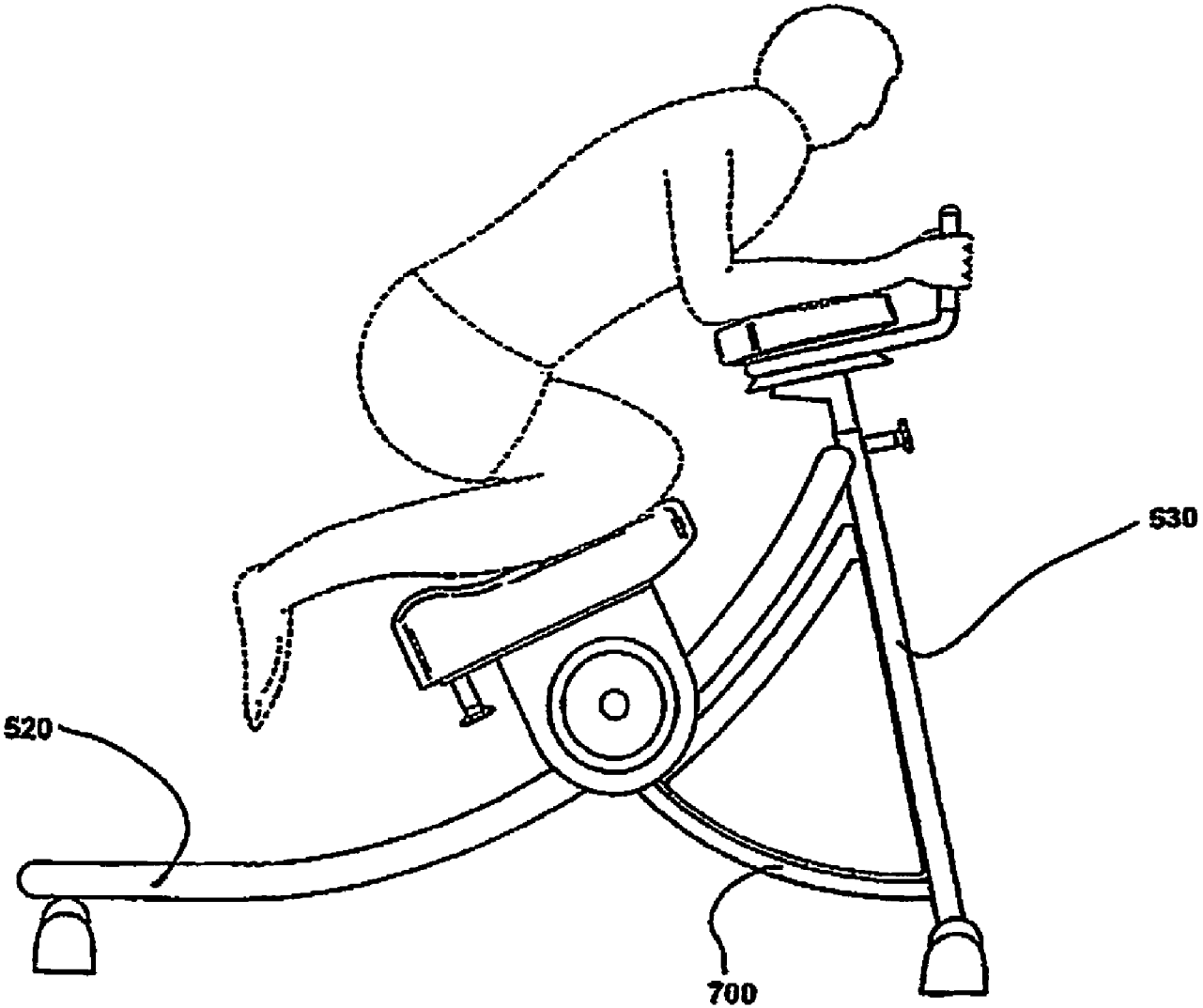
FIG. 7B is a side view of the exemplary embodiment of FIG. 6 in use by a person in accordance with one aspect of the present application.

The curved nature of the track 520 allows the user to roll his knees towards his chest (see FIG. 7B). It is believed that rolling the knees towards the chest provides for a more effective and safe crunch style abdominal exercise as opposed to the traditional sit up where the person would only pivot at his hips, which could cause injury. Furthermore, the current application eliminates or minimizes the ability to "cheat" since the entire motion can only be achieved with the abdominal muscles. In the traditional sit-up a person tends to put his hands behind his head pull his head with his arms to facilitate the exercise. This reduces the effectiveness of the exercise as well as creating strain on the neck. In other abdominal exercise devices that also provide for this rolling motion, the user lies on his back, grasps handles then rolls his back into a crunch. However, this again allows for "cheating" as the user could use his arms to facilitate the rolling process.

The convex side of the curved track 520 rests on a support surface such as the floor. The track 520 can be curved both at the front portion 522 and the back portion 524, as shown in FIG. 5A, or the track can be curved at the front portion 522 only, as shown in FIGS. 5B, 6, and 7A-7B. Having the curvature extend to the back end allows the user to exercise his lower back muscles as well.

Figure 8:
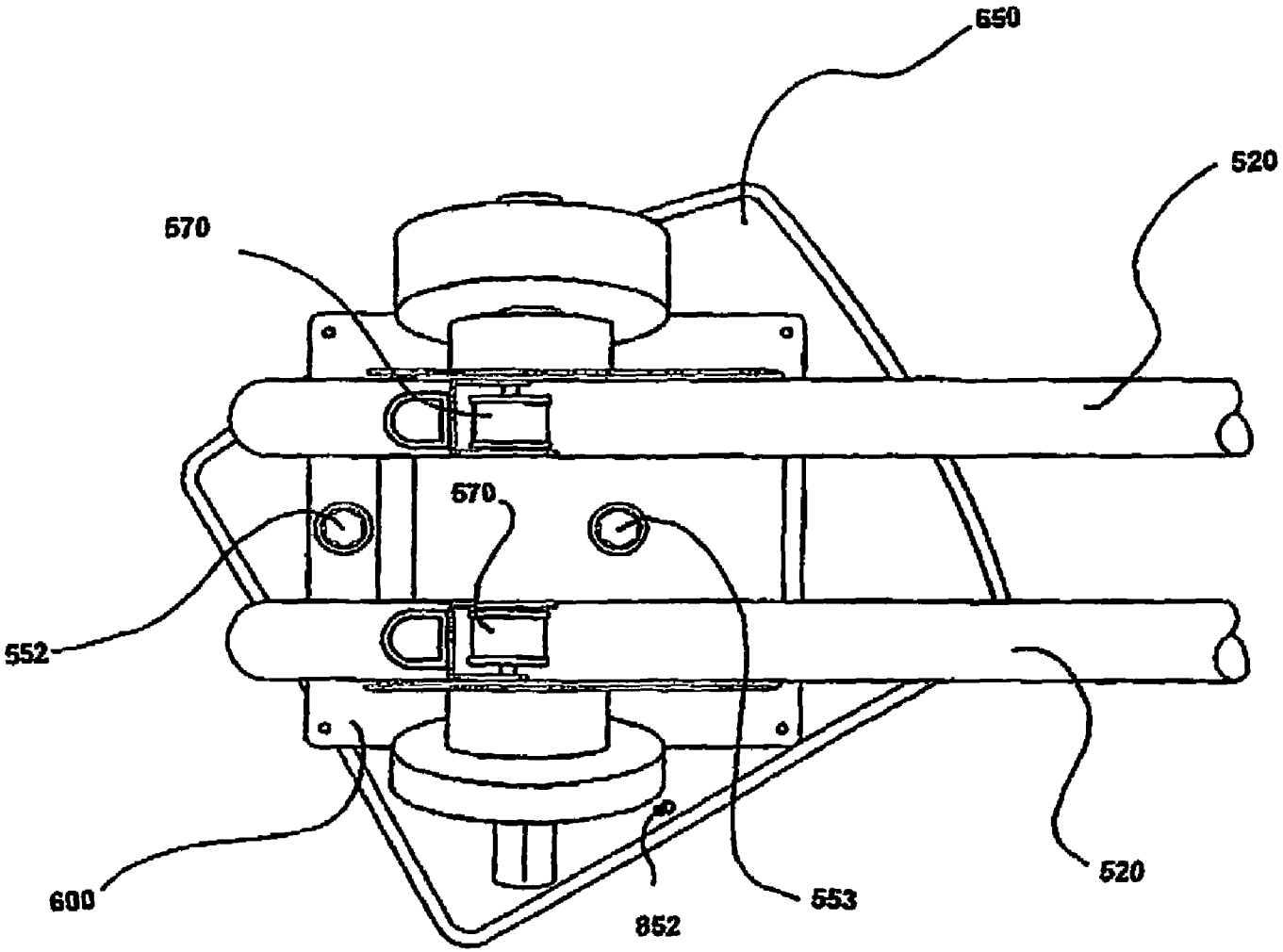
FIG. 8 is a bottom view of the illustrative leg support and track in accordance with one aspect of the present application.

As shown in FIG. 8, the knee pad or leg support 550 can be slidably mounted on the track 520, and preferably an arcuate track 520. The sliding mechanism 570 can be a rolling element, such as wheels, a plurality of bearings, such as ball bearings or roller bearings, or a gliding mechanism such as a four bar linkage. Alternatively, the knee pad or leg support 550 can be mounted on the sled 600, where the sled 600 can be slidably mounted on the track 520, and preferably an arcuate track, 520 via the aforementioned mechanisms. In a preferred embodiment the leg support 550 can be rotatably mounted to the sled 600. The leg support 550 can rotate up to approximately 45 degrees to the right or left of a plane vertical to the center of the sled 600. In other words, the leg support 550 can rotate up to approximately 45 degrees clockwise or counterclockwise about an axis 553 generally perpendicular to the arcuate track 520.

In a more preferred embodiment the leg support 550 can have a first locking member 552 having a first position and a second position. In the first position the first locking member 552, for example, a lug or pin, disengages the leg support 550, allowing the leg support 550 to freely rotate about an axis 553 that is generally perpendicular to the arcuate track 520. This rotating, pivoting, or swiveling action allows the user to twist his lower body to the left or right while performing an abdominal crunch thereby exercising his left or right oblique abdominal muscles. In the disengaged position the user can alternate exercising his left and right oblique abdominal muscles with each repetition. In the second position the leg support 550 can be locked in a predetermined orientation relative to the sled 600. This stabilizes the leg support 550 to allow the user to concentrate on the exercise rather than focusing on keeping the leg support 550 in a proper orientation. The leg support 550 can be locked at predetermined positions ranging from zero to about 45 degrees to the right or left of a plane vertical to the center of the sled 600. In some versions the locking member is a retractable lug member, pop pin, or pin and yoke configuration.

If the user wants the leg support 550 to be fixed at a particular angle during the exercise, whether the angle is parallel to the track, 45 degrees oblique to the track, or any angle in between, the user simply rotates the leg support 550 to the desired angle and moves the lug or pin 552 into the engaged position by inserting it into an indentation or recess 852 in the engagement surface. Although FIG. 8 shows one indentation or recess 852 there can be a plurality of indentations or recesses 852. As such, the engagement surface of receptor block or yoke comprises a plurality of recesses 852, where each recess 852 is shaped to accept the lug or pin member 552. In the illustrated embodiment, the lug 552 is spring activated, and releasing the lever causes a compression spring (not shown) to force the lug down towards the engagement surface.

Other pin and yoke configurations are equally contemplated, however, within the present application, including a cog and sprocket arrangement, or alternatively, a threaded pin that requires the user to press the pin into the desired hole, which is tapped with mating threads, and requires twisting the pin into the engaged position in the hole in order to lock the leg support 550 into a desired orientation. The pin and yoke combination could also be replaced with a mechanism comprising engaging teeth, such as a pawl and ratchet wheel, or other such clutch mechanism or one or many clamping configurations such as a tightening strap and tactile contact surface, or the like. With such alternatives, the allowable angular positions of the leg support 550 may be discreet positions (such as with a pin and hole combination) or may be continuous (such as with other common clamping configurations). As a result, the leg support 550 may be freely pivoted about the pivot axis during an exercise, adding to the diversity of abdominal muscle exercises that can be performed. For example, the lug may be removed from the surface and withheld from engaging any of the recesses 852 in the surface either by moving the lug to a plane offset from the recesses 852 or by retaining the lug in the disengaged position so that it is held away from the surface itself during the exercise.

To move the leg support 550 in such a way, the user would release the first locking member 552 from an engaged position to a disengaged position before an exercise to allow the leg support 550 to pivot about a pivot axis, in which the leg support 550 can be locked at any one of a plurality of angles relative to a plane vertical to the center of the sled 600 based on the desired exercise such as in FIG. 8.

The knee pad or leg support 550 can be designed to provide a more supportive and more stylish leg support 550. For example, the knee end can be indented and the ankle end can be raised so as to conform to the contours of the front portion of the average leg.

The upper body support 540 is fixedly mounted in relation to the track 520, and preferably an arcuate track 520. Having the upper body support 540 fixed allows the user to stabilize the upper body and focus the exercise on the abdominal muscles as shown in FIG. 7B. In addition to providing a more effective crunch, having the upper body support 540 fixed facilitates the user to engaging in other cognitive activities such as reading, watching television, or conversing with others. The upper body support 540 can have an elevation bar 542, a cross bar 544, and at least one arm pad or arm support 546. In another embodiment the upper body support 540 can have at least one handle 548 for the user to grasp during the exercise. The upper body support 540 can also have at least one chest pad and at least one head pad.

The upper body support 540 can have a second locking member 549 for selectively adjusting the height of the upper body support 540. In a preferred embodiment the second locking member 549 for selectively adjusting the height of the upper body support 540 can be on the elevation bar 542. The second locking member 549, such as a pop pin or any other locking member described previously, can be disengaged from the front support 530 to allow the upper body support 540 to slide up or down to a desired height, then the locking member can be re-engaged to lock the upper body support 540 in place at the desired height. The elevation bar 542 can be cylindrical in shape to provide a means for rotating the upper body support 540 without having to remove the elevation bar 542 from the front support 530. The elevation bar 542 can further have recesses on opposite sides such that the upper body support 540 can be arranged in at least two different orientations.

As shown in FIG. 5B, the upper body support 540 can be pivotally attached to the front portion 522 of the track 520, and preferably an arcuate track 520. In a preferred embodiment the cross bar 544 of the upper body support 540 can be pivotally attached to the elevation bar 542 and suspended approximately 12 to approximately 48 inches above the arcuate track 520. The embodiments illustrated in FIGS. 5A and 5B show two such mechanisms for providing this adjustability of the upper body support 540, but other telescoping and gear mechanisms are equally contemplated and within the scope of the present application.

Having the upper body support 540 pivotally attached to the front portion 522 of the arcuate track 520 or the elevation bar 542 allows the handles 548 to pivot from a first position to at least a second position to perform a different type of exercise or isolate a different abdominal muscle group. For example, in a first position the handles 548 can be above the track, in front of the arm pad 546 so that the user can grasp the handles 548 with his knuckles facing forward while resting his upper body on the arm pad 546 (see FIGS. 7A and 7B). In a second position the upper body support 540 can be rotated 180 degrees about an axis protruding up from the front support 530 and then tilted slightly downward by pivoting the upper body support 540 downward about an axis perpendicular to the front support 530 and to the arcuate tracks 520 so that when the user grasps the handles 548 his arms and elbows are tucked in near his rib cage with his knuckles facing a downward direction (see FIG. 5B). Alternatively, the upper body can be placed in a second position by pivoting the handles 548 downward 180 degrees and rotating the upper body support 540 about an axis protruding from the longitudinal direction of the cross bar 544.

To provide for a means for pivoting, the upper body support 540 or cross bar 544 can be detachably coupled to the elevation bar 542 with recesses for receiving a locking member on opposite sides such that the upper body support 540 can be rotated 180 degrees and locked back into the elevation bar 542 in a new orientation. Alternatively, the elevation bar 542 can be cylindrical such that when the locking member is disengaged, the upper body support 540 can be rotated into a new orientation without having to remove the upper body support 540 from the front support 530. In another embodiment the upper body support 540 can be pivotally coupled to the elevation bar 542 via any number of common pivot connections, such as a ball and socket or toothed mechanism. The downward rotation of the upper body support 540 can be accomplished with a variety of hinge-like mechanisms.

The arm pad 546 can be removable so as not to cause interference with the normal use of the exercise device, particularly when the handles 548 of the exercise device are in the lowered position (see FIG. 5B). The elbow portion of the arm pad 546 can be raised to prevent slippage during the exercise.

Figure 6:
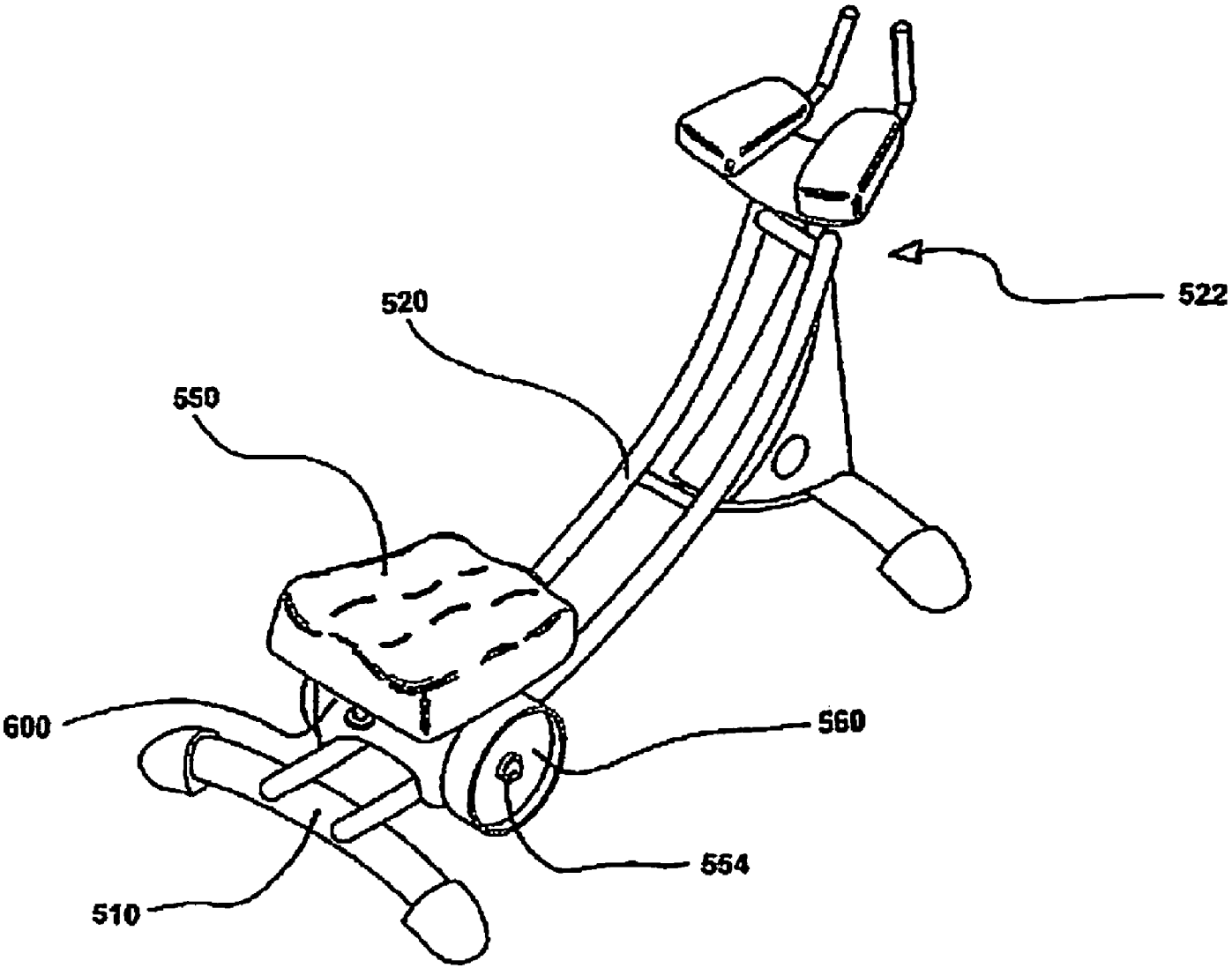
FIG. 6 is a perspective view of another exemplary embodiment in accordance with one aspect of the present application.

As shown in FIG. 6, the abdominal exercise machine 500 can further comprise a resistive or resistance member 560 to increase the resistance required to move the sled 600 or the leg support 550. The resistance member 560 can be on the leg support 550, the sled 600, or the track 520, and preferably an arcuate track 520. The resistance member 560 can be weights, elastomer members, spring members, viscous members, pneumatic members, or any other means to increase the force required to move the sled 600 along the track. For example, the leg support 550 or sled 600 can have a protrusion 554 to which weights can be added. Alternatively, one end of an elastomer, spring, or pneumatic member can be attached to the protrusion 554 and the other end of the elastomer, spring or pneumatic member can be attached to the front portion 522 or rear support 510. The degree of resistance can be changed by adding more weights, elastomer members, or spring members or by selecting heavier weights, elastomer members with lower elasticity, spring members with higher tension, pneumatic members with higher pressure or any combination thereof.

Both the front support 530 and rear support 510 can each further comprise a third and fourth locking members 532 for selectively adjusting the height of the front portion 522 or back portion 524 of the track 520, and preferably an arcuate track 520, respectively (see FIG. 5A). The third and fourth locking members 532, such as a pop pin or any other locking member described previously, can be disengaged from the front support 530 or rear support 510 to allow the front support 530 or rear support 510 to slide up or down to a desired height, then the third and fourth locking members 532 can be re-engaged to lock the front support 530 or rear support 510 in place at the desired height.

FIGS. 7A and 7B show the abdominal exerciser further comprising a stabilizing bar 700. The stabilizing bar 700 can be pivotally coupled to the track 520, and preferably an arcuate track 520, and detachably coupled to the front support 530. Furthermore, the front support 530 can be pivotally coupled to the arcuate track 520. This provides a means for folding up the exercise machine 500 when not in use. When a user has completed his exercise he can detach the stabilizing bar 700 from the front support 530 and pivot the stabilizing bar 700 up towards the front portion 522 of the arcuate track 520. The stabilizing bar 700 can then be attached to the front portion 522 of the arcuate track 520 or the top portion of the front support 530. In addition, the bottom portion of the front support 530 can be pivoted towards the middle portion of the arcuate track 520 and attached to the middle portion of the arcuate track 520.

In use, as shown in FIGS. 4 and 7B, abdominal crunches can be accomplished by positioning the body on an abdominal exercise machine 500 and using the abdominal muscles to accelerate the sled 600 from the back portion 524 of the track 520, and preferably an arcuate track 520, to the front portion 522 of the track 520 wherein the knees are on the sled 600 and the upper body is on the upper body support 540, and returning the sled 600 to its original or resting position, thereby completing a repetition.

Prior to using the exercise machine 500, the user must set up the machine 500 to suit the user's specifications by adjusting the height of the upper body support 540 by disengaging the second locking member 549, adjusting the upper body support 540 to the desired height, and re-engaging the second locking member 549. In addition, the height of the track 520 can be adjusted by removing a third and fourth locking member, moving the front portion 522, the back portion 524, or both to the desired height, and re-engaging the third and fourth locking member. Also, the user can adjust the positioning of the upper body support 540 by disengaging the second locking member 549, rotating the upper body support 540 180 degrees about an axis protruding longitudinally from the front support 530, then tilting the upper body support 540 downward until the handles 548 are in a desired lowered position, such that the elbows are near the ribcage. From this position the user can return the upper body support 540 to the original position by disengaging the second locking member 549, rotating the upper body support 540 180 degrees, then tilting the upper body support 540 upward until the handles 548 are in the original position such that the elbows are positioned on the arm pad 546 in front of the body. Alternatively, the upper body support 540 can be re-positioned by rotating the handles 548 180 degrees downward, disengaging the second locking member 549, rotating the upper body support 540 about an axis protruding longitudinally from the cross bar 544, and re-engaging the second locking member 549 when the handles 548 are in the desired position.

Once these preliminary adjustments have been made, the user can perform the exercise by placing the user's legs or knees on a leg support 550 slidably mounted to at least one track 520, preferably an arcuate track 520, placing the user's arms on an upper body support 540 fixedly mounted in relation to the track 520, pulling the user's legs and leg support 550 along the track towards the user's chin thereby performing a contraction of the user's abdominal muscles, moving the user's knees and leg support 550 along the track 520 away from the user's chin thereby allowing the user's abdominal muscles to relax and repeating the pulling and moving steps in order to exercise the user's abdominal muscles. In abdominal exercisers 500 where both the front portion 522 and the back portion 524 of the arcuate track 520 is curved an additional lower back exercise can be performed by including the steps of moving the leg support 550 towards the back portion 524 of the arcuate track 520 thereby contracting the user's lower back muscles, then moving the user's knees and leg support 550 along the arcuate track 520 away from the back portion 524 of the arcuate track 520 thereby relaxing the lower back and repeating these steps in order to exercise the lower back muscles.

The intensity of the exercise can be modified by adding a resistive or resistance member 560 to the leg support 550, the sled 600, or the track 520, and preferably an arcuate track 520. The user can select a desired weight, an elastomer member of a desired elasticity, a spring member of a desired tension, a viscous member of a desired viscosity, or a pneumatic member of a desired pressure. If the resistive member 560 is a weight, the user can simply place the weight on a protrusion 554 from the sled 600 or leg support 550. The user can add a single desired weight or multiple weights to achieve the desired weight. If the resistive member 560 is an elastomer member, a spring member, or a pneumatic member, the user can attach these members to the front or the rear support 530, 510 and the sled 600 or leg support 550.

Further steps can include disengaging a leg support 550 by placing a first locking member 552 into a first position and rotating the leg support 550 to one side up to approximately 45 degrees about an axis generally perpendicular to the at least one arcuate track 520, performing a first repetition, rotating the leg support 550 to the other side up to approximately 45 degrees about an axis generally perpendicular to the at least one arcuate track 520, performing a second repetition, and repeating a plurality of repetitions while alternating the rotation of the leg support 550 from one side to another in between each repetition to complete a set of abdominal exercises. This allows the user to alternate exercising one oblique then the other during a set of exercises.

An alternative step can include locking the leg support 550 in a predetermined position by placing the first locking member 552 into a second position such that the leg support 550 is rotated about an axis that is generally perpendicular to the at least one track, up to 45 degrees oblique from a forward direction, completing a plurality of repetitions to complete a set of abdominal exercises, disengaging the first locking member 552 and rotating and locking the leg support 550 in a second predetermined position, up to 45 degrees oblique from the forward direction, and completing a second plurality of repetitions to complete a second set of abdominal exercises. This allows the user to completely exercise one side of the oblique muscles then switch to exercising the other side.

Figure 9:
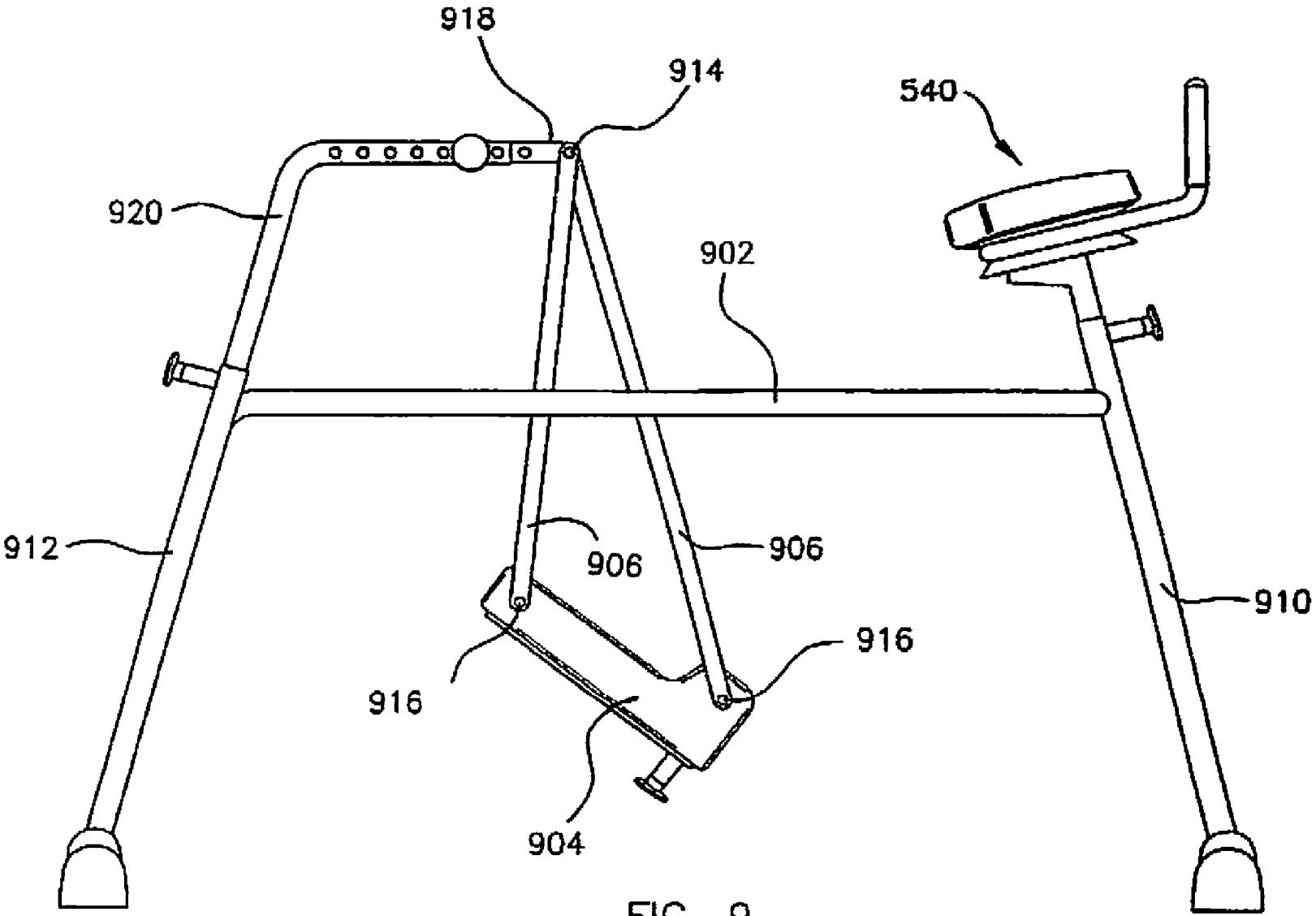
FIG. 9 is a side view of an illustrative abdominal exercise apparatus using an exemplary swing in accordance with one aspect of the present application.

FIG. 9 shows another embodiment of the abdominal exerciser 500 with the arcuate track 520 replaced by a swing configuration comprising a swing frame 902, at least one swing-arm 906, a carriage 904, and an upper body support 540.

The swing frame 902 provides structural support for the swing-arm 906 and may be fixed relative to the upper body support 540. The swing frame 902 can be mounted to a back leg 912. In one embodiment, the height of the swing frame 902, as well as possibly back leg 912, is adjustable in order to adjust the height or positioning of the carriage relative to the floor or the upper body support 540. The present application also contemplates that the swing-arm 906 can also be adjustable or at least be of a predetermined length in order achieve a swing radius within the range of approximately 6 to approximately 70 centimeters. Or more particularly, the length of the swing-arm 906 could be of sufficient length to achieve a swing radius of between approximately 12 and approximately 46 inches.

In some embodiments, the swing frame 902 further comprises a horizontal extension bar 918, wherein the carriage 904 is attached to the horizontal extension bar 918 by the swing-arm 906. The horizontal extension bar 918 can be adjusted to change the distance between the carriage 904 and the upper body support 540. In other words, the horizontal extension bar 918 allows for horizontally adjusting the carriage 904. In some embodiments, the swing frame 902 further comprises a vertical extension bar 920, wherein the carriage 904 is attached to the vertical extension bar 920 by the swing-arm 908. The vertical extension bar 920 may be adjustable or telescoping so as to change the height of the carriage 904. In some embodiments, the vertical extension bar 920 may be movably or pivotably connected to the back leg 912 to adjust both the height of the carriage 904 and the distance between the carriage 904 and the upper body support 540. In some embodiments, the swing frame 902 comprises both the horizontal extension bar 918 and the vertical extension bar 920.

Figure 10:
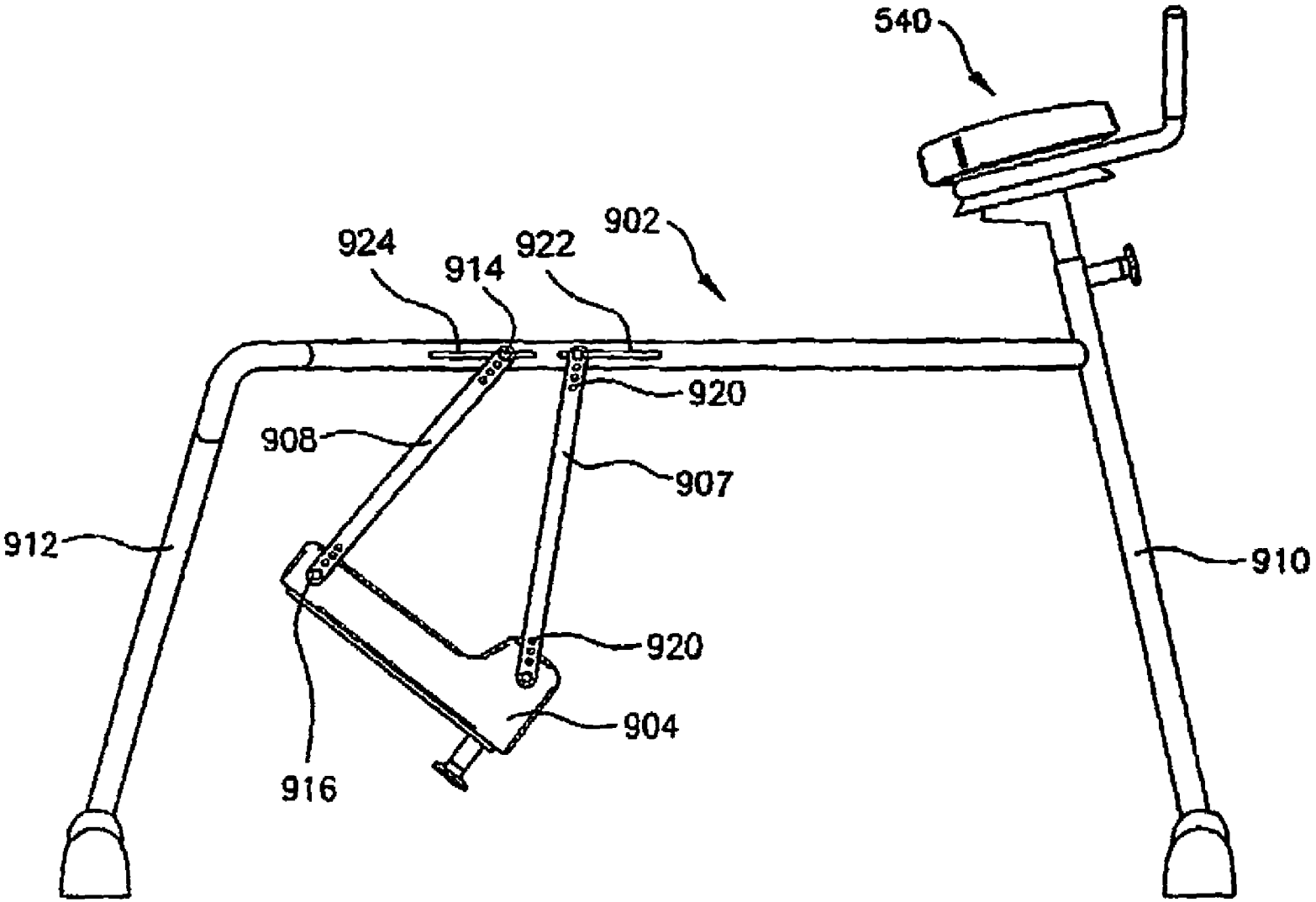
FIG. 10 is a side view of another illustrative abdominal exercise apparatus using an exemplary swing in accordance with one aspect of the present application.

FIG. 10 shows another alternative embodiment of the abdominal exerciser 500 with the arcuate track 520 replaced by another swing-arm or four-bar linkage mechanism. An abdominal exercise machine 500 utilizing such four-bar linkage mechanism comprises a swing frame 902, an upper body support 540, a carriage 904, a first swing-arm 907, and a second swing-arm 908.

The swing frame 902 provides structural support for the first and second swing-arms 907 and 908 and the upper body support 540. The swing frame 902 can further comprise a front leg 910 and a back leg 912. In another embodiment, the height of the front leg 910 and back leg 912 are separately adjustable.

In such an embodiment, first and second swing-arms 907 and 908 are pivotally connected to the swing frame 902 at a frame hinge 914 and pivotally connected to the carriage 904 at a carriage hinge 916. Additionally, the second swing-arm 908 may be configured either parallel or oblique to the first swing-arm 907, to create a four-bar linkage system. Pivotally connecting the first and second swing-arms 907 and 908 to the swing frame 902 allows the carriage 904 to swing forward and backward in a plane that is generally parallel to the plane defined by the swing frame 902. By connecting the first and second swing-arms 907 and 908 to the swing frame 902 and the carriage 904 such that the first swing-arm 907 and the second swing-arm 908 are non-parallel or oblique, the carriage 904 will swing in an arcuate path but not necessarily a circular path. By adjusting the positioning of the first and second swing-arms 907 and 908 and the relative angle therebetween, the user can experience different arcuate paths, including for example, a path similar to the arcuate track 520 of FIG. 7A but also other arcuate paths that combine a pivotal element with a horizontal element. Each different arcuate path created thereby can provide a different feel for the user's knees, legs, and targeted muscle groups.

In some embodiments, the swing frame 902 also comprises a first swing-arm slot 922 and a second swing-arm slot 924, as shown in FIG. 10. The first swing-arm slot 922 and the second swing-arm slot 924 provide a degree of freedom for the first swing-arm 907 and the second swing-arm 908. This degree of freedom increases the range of movement through which the carriage 904 can swing along the arcuate path. In embodiments with first swing-arm slots 922 and second swing-arm slots 924, the first and second swing-arms 907 and 908 can further comprise a clamping mechanism such that the location of the first swing-arm 907 and the second swing-arm 908 can be fixed.

In some of the foregoing embodiments, the carriage 904 may further comprise a leg support rotatably mounted inside the carriage 904. A rotatable leg support will allow the user to rotate or swivel his or her hips from side to side thereby exercising the oblique abdominal muscles. The leg support may also comprise a locking member to lock the leg support in place. The leg support may further comprise one or more indentations or recesses to accept the locking member so that the leg support can be fixed in a variety of positions ranging from approximately ±45 degrees oblique to the carriage 904 (i.e., left to right).

The abdominal exerciser 500 can further comprise a resistance mechanism to increase the resistance required to swing the carriage in an arcuate path. In one embodiment, the resistance mechanism is a weight that can be removably attached to the carriage. In another embodiment, the resistance mechanism can be an elastic or spring tether attached to the sides or bottom of the carriage and a fixed point along the frame. In another embodiment the frame can further comprise a base plate. The tether can be fixedly attached to the base plate directly below the carriage. The tether in the unstretched condition is substantially the same length as the shortest distance from the tether attachment point on the carriage and the tether attachment point on the frame or base plate when the carriage is at rest. Any departure of the carriage from the resting position would stretch the tether, thereby creating resistance.

The abdominal exerciser can have different configurations to accommodate users of different sizes and to exercise different abdominal muscle groups, such as the lower abdominals or the upper abdominals, as well as the transverse abdominals or the oblique abdominals. In other words, the distance between the swing frame 902 and the carriage 904 can be adjusted by adjusting the length of the first and second swing-arms 907 and 908. Providing first and second swing-arms 907 and 908 of the appropriate length will facilitate creating an arcuate path that, when followed, allows movement of the back that follows the natural curvature of the back. This reduces discomfort in the back and reduces potential for back injury.

As shown in FIG. 10, the frame hinge 914 and the carriage hinge 916 may be removable and the first and second swing-arms 907 and 908 may comprise a plurality of apertures 920. The frame hinge 914 can be removed from the current aperture 920 and inserted into another aperture 920, thereby adjusting the height of carriage 904. Similarly, the carriage hinge 916 can be removed from the aperture 920 and placed in an aperture 920 at a different position to raise or lower the height of the carriage 904.

In another embodiment, the first and second swing-arms 907 and 908 are adjustable by providing first and second swing-arms 907 and 908 of different lengths to accommodate user's of different sizes or for a single user to isolate the upper or lower abdominal muscle groups. An instructional booklet can be provided to assist the user in determining which length swing-arms would be appropriate for a particular height and a particular muscle group. The instructional booklet can provide a chart so that a user of a particular height desiring to exercise a particular abdominal muscle group can quickly determine which size swing-arms would be recommended.

The first and second swing-arms 907 and 908 may be attached to the swing frame 902 and carriage 904 by any attachment mechanism that allows for quick and easy release while providing maximum stability. For example, the swing frame 902 and carriage 902 can be constructed with pins or lugs with a flange on the end protruding away from the frame. The link pins can have key hole slots where at one end of the hole is slight larger than the flange and at the other end the hole narrows to a size just slightly larger than the neck of the lug or pin. The link pin can be attached to the lug by passing the flange through the larger end of the key hole slot then sliding the link pin down so that the smaller hole cannot pass the flange.

In another embodiment, a plurality of extensions can be provided. Extensions may be miniature swing-arms that can be connected to the first and second swing-arms 907 and 908 to progressively increase the length of the first and second swing-arms 907 and 908.

In another embodiment, the first and second swing-arms 907 and 908 can be adjustable. For example, the first and second swing-arms 907 and 908 can have an outer sleeve with an inner diameter and an outer diameter and an inner sleeve with an outer diameter substantially the same size as the inner diameter of the outer sleeve to fit inside the outer sleeve. The outer sleeve can have a plurality of holes along its longitudinal axis. The inner sleeve can have a single spring loaded push pin that can fit through the plurality of holes. A user can push in the push pin and insert the inner sleeve into the outer sleeve until the push pin catches a hole that places the carriage at a desired distance from the ground.

In another embodiment, the first and second swing-arms 907 and 908 can be attached to the swing frame 902 and carriage 904 with a ball and socket configuration. A ball and socket configuration allows the carriage 904 to swing longitudinally, parallel with the plane of the swing frame 902, laterally, perpendicular to the plane of the swing frame 902, and all angles in between the plane parallel with the swing frame 902 and the plane perpendicular to the swing frame 902. Allowing the carriage 904 to swing laterally will allow the user to further exercise the oblique and transverse abdominal muscle groups.

The abdominal exerciser 500 facilitates a method to exercise the abdominal and oblique muscle groups in a biometrically neutral position. The method for exercising the abdominal and oblique muscle groups comprises the steps of pulling the user's knees along a longitudinal arcuate path towards the user's chin thereby performing a contraction of the user's abdominal muscles, such that pulling the user's knees along the longitudinal arcuate path allows movement of the user's back to follow the natural curvature of the back; moving the user's knees along the longitudinal arcuate path away from the user's chin thereby allowing the user's abdominal muscles to relax; and repeating the pulling and moving steps in order to exercise the user's abdominal muscles.

Additional steps include immobilizing the upper body by, for example, leaning on an upper body support. In addition, the user's knees may be placed on a carriage for support.

Other additional steps include pulling the user's knees along a lateral arcuate path in a lateral direction towards a first side of the user's body thereby performing a contraction of the user's first oblique and transverse abdominal muscles. Thus, the user can first move the knees in a first lateral direction, thereby contracting the oblique and transverse muscles, then move the knees in the longitudinal direction along the longitudinal arcuate path thereby contracting the rectus abdominous muscles. At this point the user can return the knees back to its original position by either reversing the steps and moving back along the longitudinal arcuate path first, then moving the knees along the lateral arcuate path to reach its original position or by moving the knees laterally in the opposite direction and then moving the knees longitudinally backward to its original position.

The exercises can further comprise the step of adding a resistive force to the user by selecting from a group of resistive members consisting of an elastomer member, a spring member, a viscous member, a pneumatic member, and a weight.

In using the abdominal exerciser 500, abdominal exercises can be performed by positioning the body on an abdominal exercise machine 500 and using the abdominal muscles to swing the carriage 904 in a back and forth motion wherein the knees or legs rest on the carriage 904 and the upper body rests on the upper body support 540. Additional steps include placing a user's hands on the upper body support 540; placing at least portions of the user's legs on the carriage 904; pulling the user's knees and carriage 904 along a longitudinal arcuate path towards the user's chin thereby performing a contraction of the user's abdominal muscles; moving the user's knees and carriage 904 along the longitudinal arcuate path away from the user's chin thereby allowing the user's abdominal muscles to relax; and repeating the pulling and moving steps in order to exercise the user's abdominal muscles. This type of exercise would primarily exercise the rectus abdominous muscles.

Exercising the oblique and transverse abdominal muscles comprises the steps of placing a user's hands on the upper body support 540 placing at least portions of the user's legs on the carriage 904; pulling the user's knees and carriage 904 along a lateral arcuate path in a first direction towards a first side of the user's body thereby performing a contraction of the user's oblique and transverse abdominal muscles; pulling the user's knees and knee pad along the lateral arcuate path in a second direction towards a second side of the user's body thereby performing a contraction of the user's second oblique and transverse abdominal muscles; and repeating the pulling steps to complete a set of oblique and transverse abdominal muscle exercises.

Exercising all the abdominal muscle groups comprises the steps of placing a user's hands on the upper body support 540; placing at least portions of the user's legs on the carriage 904; pulling the user's knees and carriage 904 along a lateral arcuate path in a first direction towards a first side of the user's body thereby performing a contraction of the user's oblique and transverse abdominal muscles; pulling the user's knees and carriage 904 along a longitudinal arcuate path towards the user's chin thereby performing a contraction of the user's abdominal muscles; moving the user's knees and carriage 904 along the longitudinal arcuate path away from the user's chin thereby allowing the user's abdominal muscles to relax; pulling the user's knees and carriage 904 along the lateral arcuate path in a second direction towards a second side of the user's body thereby performing a contraction of the user's second oblique and transverse abdominal muscles; pulling the user's knees and carriage 904 along the longitudinal arcuate path towards the user's chin thereby performing a contraction of the user's abdominal muscles; moving the user's knees and carriage 904 along the longitudinal arcuate path away from the user's chin thereby allowing the user's abdominal muscles to relax; and repeating the pulling and moving steps to complete a set of abdominal muscle exercises. This type of exercise can also be performed by pulling in the knees and carriage 904 along the longitudinal arcuate path then along the lateral arcuate path or any combination thereof. The sequence of steps listed is not intended to limit the scope of the abdominal exercise. It is within the scope of this application to alter the sequence of steps in any order to provide an exercise regimen that exercises all the abdominal muscles, including the oblique and transverse abdominal muscles.

In another embodiment, the user can use his abdominal muscles to move the carriage in a circular motion, either in a clockwise direction, a counterclockwise direction, or a combination of both directions to exercise all the abdominal muscles and even the lower back muscles.

Prior to use preliminary adjustments can be made such as adjusting the height of the swing frame 902 for user's of different size. In addition, the distance between the swing frame 902 and the carriage 904 can be adjusted by altering the length of the first and second swing-arms 907 and 908, for example, by adding or removing extensions, changing first and second swing-arms 907 and 908 of one size for first and second swing-arms 907 and 908 of another size, telescopically lengthening or shortening the first and second swing-arms 907 and 908, or attaching the frame hinge 914 and/or the carriage hinge 916 to an aperture 920 at different positions along the first swing-arm 907 and/or the second swing-arm 908.

The intensity of an exercise can be modified by adding a resistive force to the carriage by selecting from a group of resistive members consisting of an elastomer member, a spring member, a viscous member, a pneumatic member, and a weight.

Since the swing-arm embodiment of the abdominal exerciser 500 does not require a track, the swing-arm embodiment requires less maintenance since the user does not have to worry about the wear and tear of a track. In addition, the components for creating a swinging or swiveling carriage can be easier to care for and replace than the components for a rolling leg support on a track.

Figure 11:
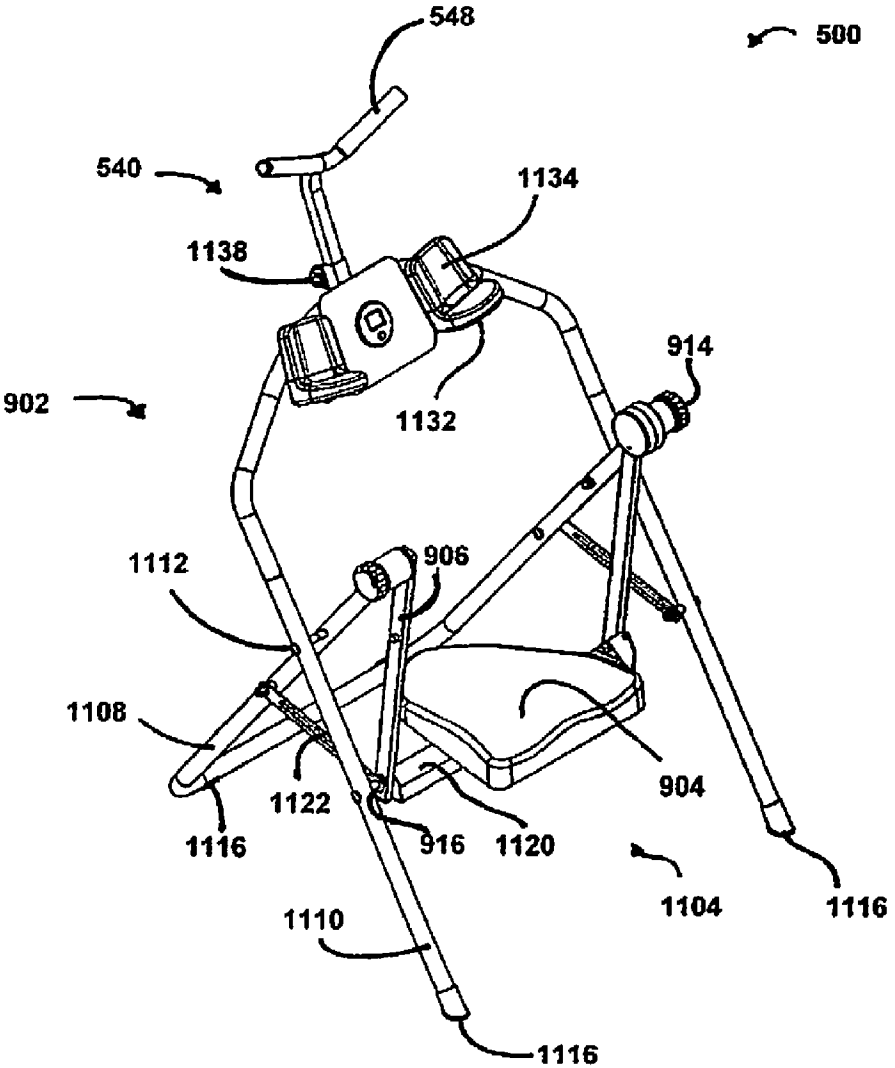
FIG. 11 is a diagram illustrating a perspective view of another exemplary abdominal exercise apparatus using a swing in accordance with one aspect of the present application.

In another embodiment of the present application, an exercise apparatus 500 having a frame 902, swing assembly 1104, and upper body support 540 is depicted in FIG. 11. The abdominal exercise apparatus 500 can work a user's abdominal and oblique muscle groups and isolate an upper and lower abdominal group in a biometrically neutral position. In an illustrative embodiment, a user places at least a portion of their lower body on a carriage 904 of the swing assembly 1104. The user leans their forearms and elbows against the angled upper body support 540 while grasping a set of handles 548 to secure their upper body. To perform the exercise, the user swings the carriage 904 back and forth with their lower body along an arcuate path beginning at a position behind the upper body support 540 and ending at a position in front of the upper body support 540, thereby contracting and relaxing their abdominal muscle group.

Furthermore, by positioning the upper body support 540 in an ergonomically position, the user will not harm or damage their back as shown in previous abdominal exercising devices. The device 500 will continue to isolate the upper and lower abdominal muscles with a true strength conditioning to change the shape of the overall abdomen muscle structure without compromising safety or support for the back. The apparatus also enables a user to execute the abdominal exercise in a biometrically neutral position, minimizing or eliminating back and neck strain. The user can perform upper abdominal crunches simultaneously with a controlled and supported reverse crunch. It also allows the user to hold either the upper or lower crunch in a fully contracted "isometric" position while continuing with the opposite crunch rendering a dynamically concentrated isolation of the abdominal muscles. The apparatus 500 allows users having infirmities, such as sinus issues, to work on their abdominal muscles.

As depicted in FIG. 11, a perspective view of an exemplary abdominal exercise apparatus 500 in accordance with one aspect of the present application is presented. The exercise apparatus 500 as shown typically includes a frame 902, a swing assembly 1104, and an upper body support 540. While the frame 902, swing assembly 1104, and upper body support 540 make up the majority of components of the abdominal exercise apparatus 500, one skilled in the relevant art will appreciate that there are numerous implementations of the abdominal exercise apparatus 500 and the embodiments described below in this application do not limit the scope of the invention.

With continued reference to FIG. 11, the frame 902 of the abdominal exercise apparatus 500 typically includes two support members: a first U-shaped support member 1108 and a second U-shaped support member 1110. Alternatively, the abdominal exercise apparatus 500 can include a single support member. One skilled in the relevant art will appreciate that the frame 902 can come in many different forms and shapes. Furthermore, the support members 1108 and 1110 can be made of different materials like plastic or metal.

The first U-shaped support member 1108 and the second U-shaped support member are coupled using a fastening device 1112. The coupled support members 1108 and 1110 provide for a sturdy base on which the user can exercise on. Typically, the fastening device 1112 can be a bolt, screw, nail, rivet, roll pin, or pinned shaft. Alternatively, the first and second U-shaped support members 1108 and 1110 can be permanently coupled by welding, soldering, brazing, or gluing the members 1108 and 1110. While several methods and devices have been presented for coupling the two U-shaped support members 1108 and 1110, one skilled in the relevant art will appreciate that there are many other ways to couple the support members 1108 and 1110 together.

When fastening devices 1112 are used, the coupled support members 1108 1110 can be easily packed and stored for later use. In one embodiment, the fastening device 1112 can be loosened to collapse the first U-shaped support member 1108 and the second U-shaped support member 1110. Alternatively, the fastening devices 1112 can be removed completely to collapse the frame 902.

In the embodiment shown in FIG. 11, the first U-shaped support member 1108 is coupled to the second U-shaped support member 1110 at two points located between the top and bottom ends of the first and second U-shaped support members 1108 and 1110. In other embodiments, the U-shaped support members 1108 and 1110 can be coupled together at different positions. For example, instead of the single point shown in FIG. 11, each support member 1108 and 1110 can include multiple apertures for coupling the two support members 1108 and 1110 together. In one embodiment of the present application, the first U-shaped support member 1108 is coupled to the second U-shaped support member 1110 at a position closer to the ground. In another embodiment, the coupling between the support members 1108 and 1110 can be further from the ground.

The angle at which the first U-shaped support member 1108 is coupled to the second U-shaped support member 1110 of the frame 902 determines the distance between the swing assembly 1104 and the ground, the angle of the upper body support 540, and the distance between the swing assembly 1104 and the upper body support 540. In one embodiment of the present application, the angles between the horizontal plane and the support members 1108 and 1110 are large. While this embodiment is less sturdy, the swing assembly 1104 is high off the ground and the user does not have to angle their back to conform their body to the upper body support 540. Furthermore, the distance between the swing assembly 1104 and the upper body support 540 is small. In another embodiment, additional attachments can be connected to the frame 902 to provide extra stability to the abdominal exercise apparatus 500.

Alternatively, the angles between the horizontal plane and the support members 1108 and 1110 are small. While this embodiment is more sturdy than the previous embodiment, the swing assembly 1104 will be low off the ground and the user has to angle their back to conform their body to the upper body support 540. Also in this embodiment, the distance between the swing assembly 1104 and the upper body 540 support is large. Thus, the angles at which the U-shaped support members 1108 and 1110 are coupled typically determines the type of user, the exercise performed, and the amount of stress placed on the back of a user.

The first U-shaped member 1108 will typically include one contacting floor member 1116 at the bottom end, while the second U-shaped member 1110 generally includes two contacting floor members 1116 at the top end. Generally, the contacting floor members 1116 can include a material having a high coefficient of friction which provides more stability for the abdominal exercise apparatus 500.

Along with the frame 902 and the upper body support 540, the abdominal exercise apparatus 500 includes a swing assembly 1104. The swing assembly 1104 typically contains several different parts including swings arms 906, pivoting hinges 914, and a carriage 904. The swing assembly 1104 allows the user to swing back and forth in an arcuate path which will be presented in more detail with respect to FIGS. 12 through 14. Furthermore, the swing assembly 1104 may include frictional or resistance components to inhibit or prevent the swinging motion.

In one embodiment of the present application, a hinge 914 is pivotally connected to the top portion of the first U-shaped support member 1108. The hinge 914 allows the carriage 904 to move in a plane defined by the radius of the hinge 914 and swing arm 906. In one embodiment of the present invention, the carriage 904 can rotate in a complete circle. Alternatively, the carriage 904 can rotate at a small angle. In each exemplary embodiment presented above, the pair of fastening devices or hinges 914 typically pivot simultaneously in a single back and forth direction.

A carriage hinge 916 connects the swing arm 906 to a carriage support member 1120. Through the carriage hinge 916 and the carriage support member 1120, the carriage 904 may pivot up and down. One skilled in the relevant art will appreciate that the carriage support member 1120 will support the majority of the user's lower body weight.

Preferably, the abdominal exercise apparatus 500 can include a set of parallel members 1122 for additional support. The parallel members 1122 are coupled to the first U-shaped support member 1108 and the second U-shaped support member 1110. The parallel members 1122 are connected at a slant between the first U-shaped support member 1108 and the second U-shaped support member 1110 of the frame 902. One skilled in the relevant art will appreciate that the parallel members 1122 do not have to be connected at a slant. Furthermore, there can be a single parallel member 1122 up to many parallel members 1122. Typically, the parallel members 1122 can be removable for easy set-up and storage of the abdominal exercise apparatus 500.

In one embodiment of the present application, the swing arms 906 and the hinges 914 are removed and the carriage 904 traverses along the parallel members 1122 between the first U-shaped support member 1108 and the second U-shaped support member 1110. The weight of the user is supported by the parallel members 1122 instead of the swing arms 906 and the hinges 914. The parallel members 1122 can provide resistance against the swinging motion of the carriage 904 either through weights or friction on the track itself. In another embodiment, the parallel members 1122 can provide less resistance to the swinging motion of the carriage 904 through the use of some type of lubrication or other similar type of material. The carriage 904 may also include a roller that can be made of metal, plastic with a metal or TEFLON® coating, or some other material that has a relatively low coefficient of friction on the material used to make the parallel members 1122. In another embodiment, the roller may have ball bearings, roller bearings, or some other means which would allow the carriage 904 to travel along the parallel members 1122 with a relatively low coefficient of friction.

In a separate but related embodiment of the present application, the parallel members 1122 can be replaced with curved parallel members 1122. Generally, the curvature can be circular, ellipsoid, parabolic, or any other curved shape that advantageously affects the abdominal and oblique muscles.

As depicted in FIG. 11, the abdominal exercise apparatus 500 includes two hinges 914. Each hinge 914 is attached to the top portion of the first U-shaped support member 1108. A pair of swings arms 906 are attached to the hinges 914. Connected to the swing arms 906 is the carriage 904.

Generally, the carriage 904 contains padding for user comfort as the carriage 904 supports a majority of the user's lower body weight. The padding preferably includes knee pads and leg supports. The knee pad or leg support can be designed to provide a more supportive and stylish leg support. For example, the knee end can be indented and the ankle end can be raised so as to conform to the contours of the front portion of the average leg.

In typical embodiments of the present application, the padding can be made of dense foam, rubber, or some other similar material. The carriage 904 can also pivot up to approximately 45 degrees to the right or left of a plane vertical to the center of the carriage 904. By pivoting the carriage 904, the oblique muscles can be effectively exercised.

The abdominal exercise apparatus 500 can include a back member that prevents the user from falling out. For example, a back member can be attached to the swing arms 906. After the user is on the carriage 904, the user can fold the back member behind them. The back member can be made of the same materials as the padding and take on a shape that conforms to the back of the user. In another embodiment, the abdominal exercise apparatus 500 can include a safety harness or belt.

The structure of the swing assembly 1104 and the frame 902 allows for easy access into and out of the carriage 904. In one embodiment of the present application, the area between the first U-shaped support member 1108 provides enough distance for a wheel chair to be carted in. The person can easily slide themselves forward onto the carriage 904 from their wheel chair and begin exercising right away. Alternatively, the distance between the first U-shaped member 1108 can be very narrow allowing for a more compact abdominal exercise apparatus 500. One skilled in the relevant art will appreciate that the width of the apparatus 500 may vary from one embodiment to the next.

As shown in FIG. 11, the frame 902 and the swing assembly 1104 are part of the abdominal exercise apparatus 500 along with the upper body support 540. While the first U-shaped support member 1108 is attached to the swing assembly 1104, the second U-shaped support member 1110 is attached to the upper body support 540.

The upper body support 540 can be attached to a bottom end of the second U-shaped support member 1110. In one embodiment, the upper body support 540 is positioned at an angle above the horizontal plane defined by the carriage 904. This provides for back support to the user.

In typical embodiments of the present application, the upper body support 540 contains at least one elbow pad 1132, forearm pad 1134, and handle bar 548. The elbow pads 1132 and the forearm pads 1134 generally provide support for the user's weight without bruising their elbows. Typically, the elbow pads 1132 support a majority of the user's upper body weight. While the elbow pads 1132 and the forearm pads 1134 have a rectangular or square shape as depicted in FIG. 11, one skilled in the relevant art will appreciate that the pads 1132 and 1134 may come in different shapes and sizes and can be made of many different materials.

This embodiment also incorporates a pair of handle bars 548. The handle bars 548 allow the user to secure themselves to the abdominal exercise apparatus 500. The handle bars 548 are oblong shaped and can include a grip-like material. In an alternative embodiment, the handle bars 548 can be rings or any other type of device that allows the user to firmly secure their upper body to the abdominal exercise apparatus 500.

The upper body support 540 can be lowered or raised through fastening and unfastening of a knob 1138 allowing users of different sizes to work out on the abdominal exercise apparatus 500. In an alternative embodiment of the upper body support 540, only the handle bars 548 are raised and lowered using the knob 1138. In another embodiment of the present application, a telescopic extension raises and lowers the height of the upper body support 540. In yet another embodiment, each of the U-shaped support members 1108 and 1110 can have telescoping extensions.

In sum, the abdominal exercise apparatus 500 includes a frame 902, swing assembly 1104, and upper body support 540. The frame 902 contains a first U-shaped support member 1108, second U-shaped support member 1110, fastening devices 1112, contacting floor members 1116, and optional parallel members 1122.

The swing assembly 1104 contains swings arms 906, pivoting devices 914, and a carriage 904 on top of a support member 1120. In addition, the swing assembly 1104 may contain padding for the carriage 904. The upper body support 540 contains elbow pads 1132, forearm pads 1134, and handle bars 548. The components described above in this application are for illustrative purposes and do not limit the scope of the invention. One skilled in the relevant art will appreciate that there may be several additional pieces to the abdominal exercise apparatus 500.

The abdominal exercise apparatus 500 can also include a microcomputer. In one embodiment, the microcomputer can be attached to the upper body support 540 and display information regarding the user progress such as calories burned, swings made, etc. The microcomputer can also be used to adjust friction on the swing assembly 1104 and calculate the user's heart rate.

Figure 12:
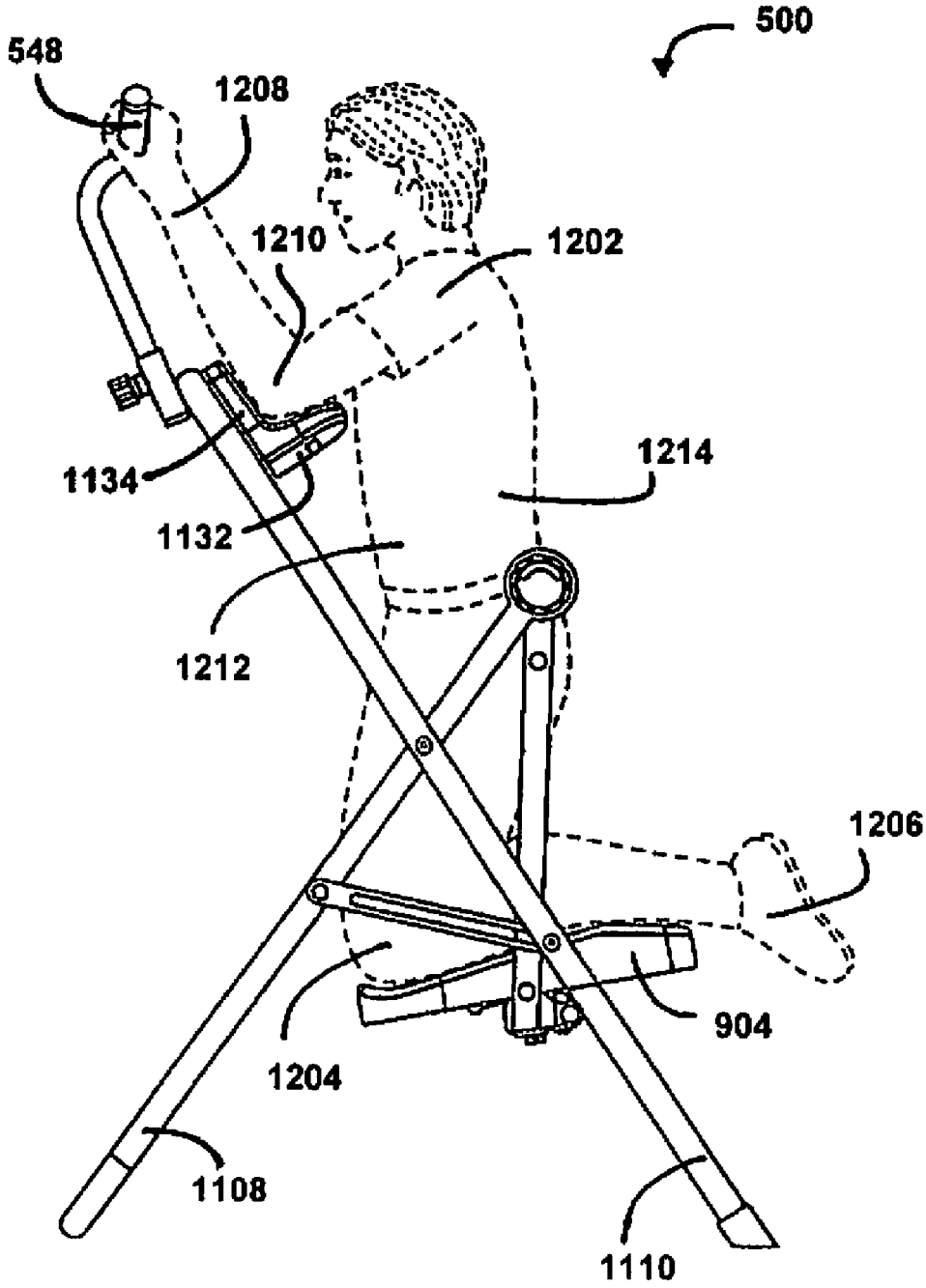
FIG. 12 is a diagram illustrating a user in a relaxed abdominal muscle group position using an exemplary abdominal exercise apparatus in accordance with one aspect of the present application.

FIG. 12 is a diagram illustrating a user 1202 in a relaxed abdominal muscle group 1212 position using an exemplary abdominal exercise apparatus 500 in accordance with one aspect of the present application. Initially, the user 1202 places their body between the first U-shaped support member 1108 and the second U-shaped support member 1110 of the frame 902. The user 1202 places their knees 1204 onto the carriage 904 or at least a portion of the user's 1202 lower body on the carriage 904 while facing towards the upper body support 540. Typically, the user's 1202 feet 1206 will hang out over the carriage 904.

In turn, the user 1202 leans their forearms 1208 and elbows 1210 against the forearm pads 1134 and elbow pads 1132 of the upper body support 540. In one embodiment of the present application, the upper body support 540 is at an angle relative to a plane defined by the carriage 904. After the user 1202 places their forearms 1208 and elbows 1210 against the pads 1132 and 1134, the user 1202 grasps the set of handles 548 of the upper body support 540 to secure and hold the user's 1202 upper body.

In this relaxed abdominal muscle group 1212 position, the carriage 904 is positioned below and in back of the upper body support 540. The user's 1202 back 1214 is nearly straight. The user's 1202 back 1214 is supported by a combination of the upper body support 540 and the carriage 904. The abdominal exercise apparatus 500 therefore places little or no strain on the back 1214 of the user 1202.

Figure 13:
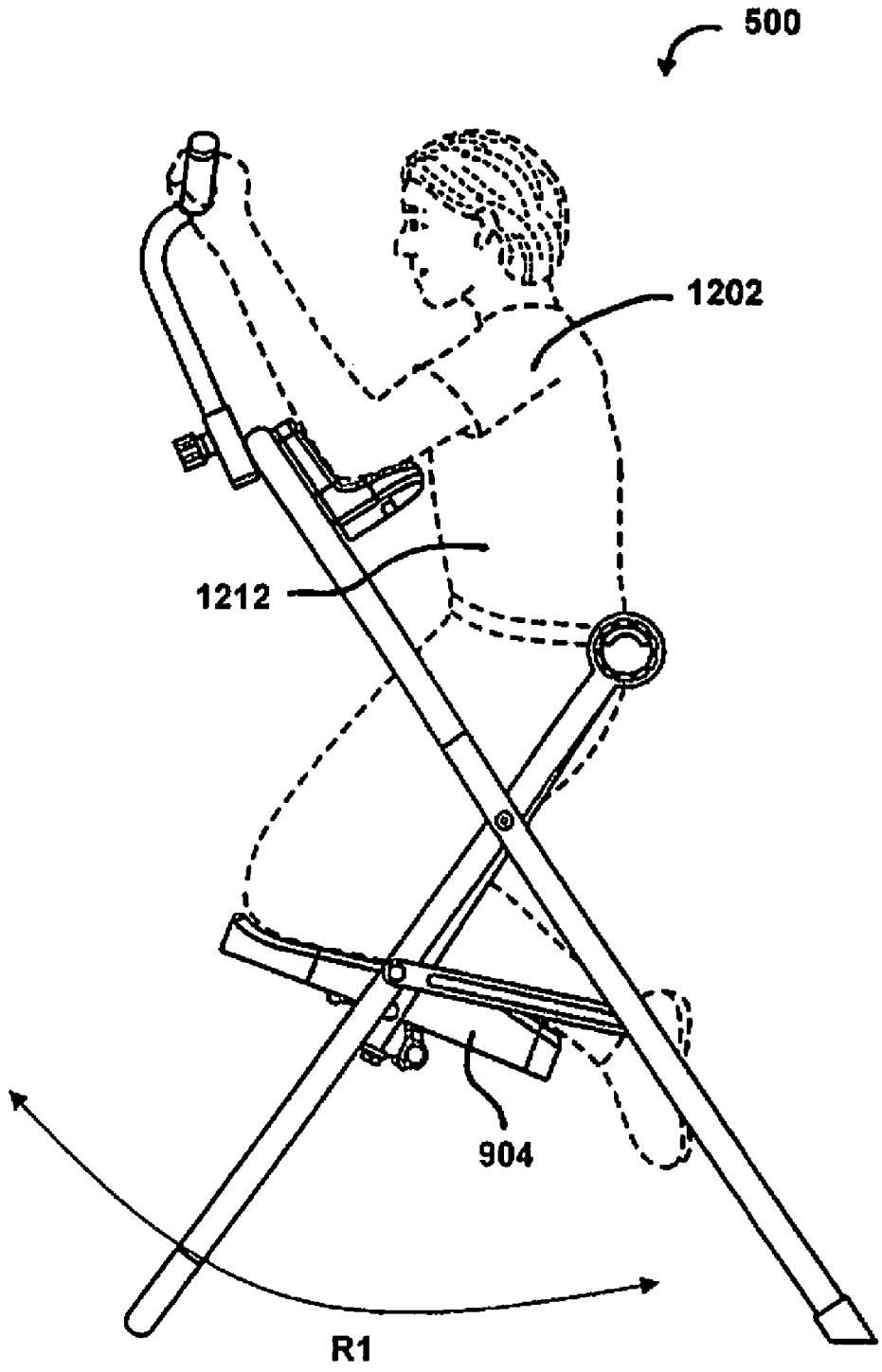
FIG. 13 is a diagram illustrating a user swinging their body using an exemplary abdominal exercise apparatus in accordance with one aspect of the present application.

With reference to FIG. 13, a user 1202 swinging their body using an exemplary abdominal exercise apparatus 500 in accordance with one aspect of the present application is presented. The user 1202 continues to firmly secure their upper body by placing their elbows 1210, forearms 1208, and arms into the elbow pads 1132, forearm pads 1134, and handle bars 548 of the upper body support 540. While holding to the upper body support 540, the user 1202 swings the carriage 904 along with the user's knees 1204 and feet 1206 in a back and forth motion along an arcuate path defined by line R1 using their abdominal muscles 1212. Typically, this path is determined by the swing arm 906 and hinge 914 of the swing assembly 1104.

The swinging motion by the user 1202 causes the hinge 914 to pivot the swing arm 906 connected to the carriage 904. In accordance with this embodiment, the carriage 904 provides support for the back 1214 during this motion. Again, the abdominal exercise apparatus 500 places little or no strain on the back 1214 of the user 1202 in this contracted abdominal muscle group 1212 position.

In another embodiment, by pivoting the carriage 904 up to approximately 45 degrees to the right or left of a place vertical to the center of the pivoting hinge 914, the force needed to accelerate the carriage 904 can be supplied by the right or left oblique muscles. In addition, the knees 1204 may be brought as high as possible at the peak of the contracted point of both crunches, renderings a tight squeeze in a near fetal position.

By swinging further back and forth along line R1, the abdominal exercise apparatus 500 targets the abdominal muscle group 1212 and the muscles 1212 are contracted. For some users 1202, the contracted abdominal muscle group 1212 position occurs when the carriage 904 is positioned directly below the upper body support 540.

Figure 14:
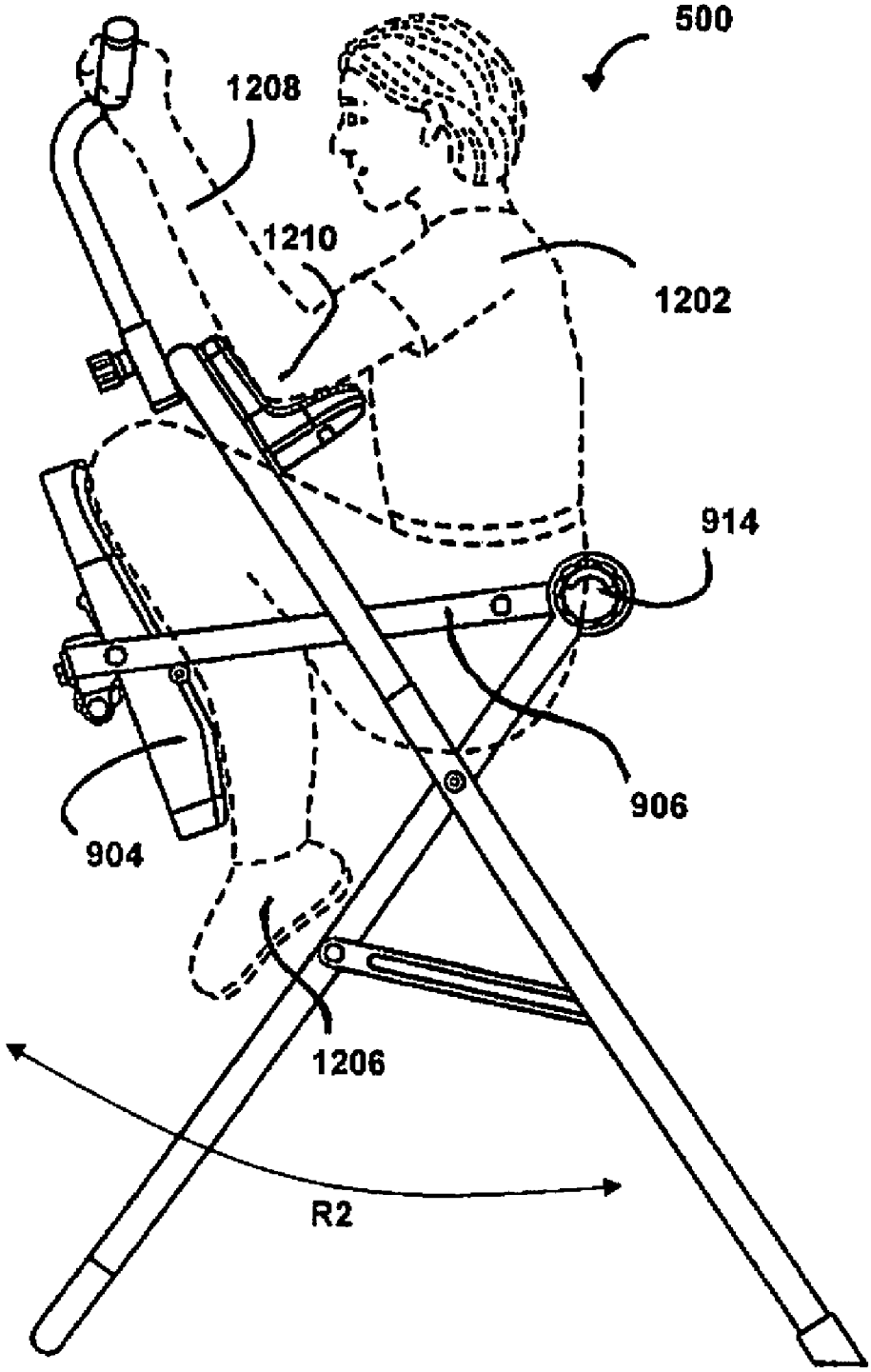
FIG. 14 is a diagram illustrating a user in a contracted abdominal muscle group position using an exemplary abdominal exercise apparatus in accordance with one aspect of the present application.

With reference to FIG. 14, a diagram illustrating a user 1202 in a contracted abdominal muscle group 1212 position using an exemplary abdominal exercise apparatus 500 in accordance with one aspect of the present application is presented. In this contracted abdominal muscle group 1212 position, the carriage 904 has traversed line R2 and is positioned in front of the upper body support 540. In one embodiment, the user's knees 1204 and feet 1206 have shifted about 90 degrees from the relaxed abdominal muscle group 1212 position along with the carriage 904, swing arm 906, and hinge 914. Alternatively, the carriage can be in front and below the upper body support 540 in a full contracted abdominal muscle group 1212 position.

The shift into the contracted abdominal muscle group 1212 position will generally be a little more strenuous on the back 1214. However, the user 1202 can still support a majority of their weight by using the upper body support 540. Additionally, the swing assembly 1104 can still support a portion of the user's 1202 weight. The contracted abdominal muscle group 1212 position provides the most preferable workout for the user 1202.

In another embodiment of the present application, the user 1202 can adjust the angle at which the user's 1202 forearms 1208 and elbows 1210 are positioned or leaned against the upper body support 540. Also, the user can adjust the fastening device 1112 on the frame 902. Generally, the greater the angle between the horizontal plane defined by the carriage 906 and the upper body support 540, the less strain on the user's 1202 back 1214.

In an alternative embodiment, the user 1202 can adjust the upper body support 540. This can be used for different types of bodies. The user 1202 can also adjust the distance between the swing assembly 1104 and the upper body support 540. In one embodiment, the swing arm 906 can be adjusted. One skilled in the relevant art will appreciate that height and distances can be adjusted in many different ways that conform to the scope of this invention as described in this application.

Although the elements were recited in a sequential method, one skilled in the relevant art will appreciate that the steps to using the abdominal exercise apparatus 500 are not limited to those steps presented above or in that specific order. Furthermore, although the invention has been described with reference to one or more preferred embodiments, the description is not to be construed in a limiting sense. There is modification of the disclosed embodiments, as well as alternative embodiments of this invention, which will be apparent to persons of ordinary skill in the art and various changes in form and detail may be made therein without departing from the spirit and scope of the invention. The invention shall be viewed as limited only by reference to the following claims.

What is claimed is:

1. An exercise machine to work a user's abdominal muscle group, the exercise machine comprising:

a frame;

an upper body support attached to the frame; and a swing assembly attached to the frame, wherein the swing assembly includes a swing arm connected to a carriage, the carriage traversing back and forth an arcuate path defined by the swing arm and capable of pivoting in front of the upper body support.

2. The abdominal exercise apparatus of claim 1, wherein the carriage includes a seat member and padding, the padding conforming to a user's body.

3. The abdominal exercise apparatus of claim 1, wherein the upper body support is adjustable through a telescopic extension.

4. The exercise machine of claim 1, wherein the frame comprises:

a first support member;

a second support member coupled to the first support member; and at least one parallel member, wherein each parallel member is coupled to the first support member and the second support member.

5. The exercise machine of claim 4, wherein the at least one parallel member can be removed for easy set-up and storage of the exercise machine.

6. The exercise machine of claim 4, wherein the second support member and the first support member are coupled at multiple angles for adjusting an angle of the upper body support and a distance between the carriage and the upper body support.

7. The exercise machine of claim 1, wherein the upper body support comprises:

a pair of elbow pads;

a pair of forearm pads; and a pair of handle bars.

8. The abdominal exercise apparatus of claim 7, wherein the elbow pad supports a majority of a user's upper body weight and the carriage supports a majority of a user's lower body weight.

9. The exercise machine of claim 7, wherein the upper body support is angled allowing for the pair of elbow pads to support a majority of a user's upper body weight.

10. An exercise method for targeting a user's abdominal muscle groups and to isolate an upper and lower abdominal muscle group in a biometrically neutral position, the method comprising:

placing at least a portion of a user's lower body on a carriage;

positioning a user's upper body to an upper support; and using an abdominal muscle group to swing the carriage back and forth along an arcuate path, the path beginning at a position behind the upper support and ending at a position in front of the upper support; and pulling the user's lower body laterally on the carriage along the arcuate path thereby performing a contraction of a user's oblique and transverse abdominal muscles.

11. An exercise method for targeting a user's abdominal muscle groups and to isolate an upper and lower abdominal muscle group in a biometrically neutral position, the method comprising:

placing at least a portion of a user's lower body on a carriage;

positioning a user's upper body to an upper support; and using an abdominal muscle group to swing the carriage back and forth along an arcuate path, the path beginning at a position behind the upper support and ending at a position in front of the upper support;

wherein positioning a user's upper body to an upper support includes leaning a user's forearms and elbows against the upper support while grasping a set of handles of the upper support to secure and hold the user's upper body.

12. The exercise method of claim 11, further comprises leaning at an angle relative to the plane defined by the carriage.

13. The exercise method of claim 11, wherein the position behind the upper support includes relaxing the abdominal muscle group.

14. The exercise method of claim 11, wherein the position in front of the upper support includes contracting the abdominal muscle group.

* * * * *